US010416579B2

(12) United States Patent
Takeuchi et al.

(10) Patent No.: US 10,416,579 B2
(45) Date of Patent: Sep. 17, 2019

(54) ELECTROPHOTOGRAPHIC PHOTORECEPTOR, METHOD FOR PRODUCING THE SAME, AND ELECTROPHOTOGRAPHIC APPARATUS USING THE SAME

(71) Applicant: FUJI ELECTRIC CO., LTD., Kawasaki-shi, Kanagawa (JP)

(72) Inventors: Toshiki Takeuchi, Shen Zhen (CN); Seizo Kitagawa, Matsumoto (JP); Kazuya Saito, Matsumoto (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 16/045,144

(22) Filed: Jul. 25, 2018

(65) Prior Publication Data

US 2018/0329318 A1 Nov. 15, 2018

Related U.S. Application Data

(63) Continuation of application No. PCT/JP2017/007254, filed on Feb. 24, 2017.

(51) Int. Cl.

| | |
|---|---|
| ***G03G 5/05*** | (2006.01) |
| ***G03G 5/047*** | (2006.01) |
| ***G03G 5/06*** | (2006.01) |

(52) U.S. Cl.

CPC ..... *G03G 5/0564* (2013.01); *G03G 5/047* (2013.01); *G03G 5/05* (2013.01); *G03G 5/056* (2013.01); *G03G 5/0696* (2013.01)

(58) Field of Classification Search

CPC ..... G03G 5/0564; G03G 5/0696; G03G 5/056

See application file for complete search history.

(56) References Cited

U.S. PATENT DOCUMENTS

| | | | |
|---|---|---|---|
| 4,882,253 | A | 11/1989 | Kato et al. |
| 5,139,912 | A | 8/1992 | Aizawa |

(Continued)

FOREIGN PATENT DOCUMENTS

| | | | |
|---|---|---|---|
| JP | H01-243067 | A | 9/1989 |
| JP | H05-045915 | A | 2/1993 |

(Continued)

OTHER PUBLICATIONS

English language machine translation of JP 2010-237555 (Oct. 2010).*

English language machine translation of JP 2010-237511 (Oct. 2010).*

*Primary Examiner* — Christopher D Rodee

(74) *Attorney, Agent, or Firm* — Rabin & Berdo, P.C.

(57) ABSTRACT

An electrophotographic photoreceptor which, even when mounted on a high-image-quality monochrome high-speed printer or tandem color printer including a cleaner-less process of a non-magnetic single-component contact development system using a polymerized toner, inhibits the generation of fine black spots or color spots and suppresses the occurrence of toner filming during the initial printing under a high-temperature and high-humidity environment and thereby stably attains a high image quality in a variety of environments. The electrophotographic photoreceptor is a positively-chargeable electrophotographic having a contact angle between the surface of an outermost layer and water (Continued)

that is in a range of 81° to 87° and having a binder resin of an outermost layer containing resins having repeating units represented by Formula (1) and Formula (2) below:

(1)

m/(m + n) = 0.6~0.9; and (2)

x/(x + y) = 0.6~0.9.

22 Claims, 3 Drawing Sheets

(56) References Cited

U.S. PATENT DOCUMENTS

| | | | | |
|---|---|---|---|---|
| 9,529,285 | B2 * | 12/2016 | Hirata | C09D 177/10 |
| 2011/0091799 | A1 | 4/2011 | Nakamura et al. | |
| 2012/0034556 | A1 | 2/2012 | Nebashi et al. | |
| 2016/0176801 | A1 * | 6/2016 | Kato | C07D 333/76<br>257/40 |
| 2017/0075237 | A1 * | 3/2017 | Hirata | C08G 64/14 |
| 2018/0282303 | A1 * | 10/2018 | Han | C07C 211/54 |
| 2018/0307147 | A1 * | 10/2018 | Suzuki | G03G 5/047 |

FOREIGN PATENT DOCUMENTS

| | | | | |
|---|---|---|---|---|
| JP | H05-030262 | B2 | | 5/1993 |
| JP | H05-047822 | B2 | | 7/1993 |
| JP | 2000-122327 | A | | 4/2000 |
| JP | 2003-228182 | A | | 8/2003 |
| JP | 2004-347853 | A | | 12/2004 |
| JP | 2006-184692 | A | | 7/2006 |
| JP | 2007-206130 | A | | 8/2007 |
| JP | 2008-197456 | A | | 8/2008 |
| JP | 2009-288569 | A | | 12/2009 |
| JP | 2010237511 | A | * | 10/2010 |
| JP | 2010237555 | A | * | 10/2010 |
| JP | 2014-092594 | A | | 5/2014 |
| JP | 2014-109683 | A | | 6/2014 |
| JP | 2015-212837 | A | | 11/2015 |
| WO | WO-2010/064585 | A1 | | 6/2010 |

* cited by examiner

ELECTROPHOTOGRAPHIC PHOTORECEPTOR, METHOD FOR PRODUCING THE SAME, AND ELECTROPHOTOGRAPHIC APPARATUS USING THE SAME

CROSS-REFERENCE TO RELATED APPLICATIONS

This non-provisional application is a continuation of International Application No. PCT/JP2017/007254 filed on Feb. 24, 2017, the entire contents of which are incorporated herein by reference.

BACKGROUND OF THE INVENTION

1. Field of the Invention

The present invention relates to an electrophotographic photoreceptor (hereinafter, also simply referred to as "photoreceptor"), and an electrophotographic apparatus using the same. More particularly, the present invention relates to an electrophotographic photoreceptor used in electrophotographic printers, copying machines, fax machines and the like; and an electrophotographic apparatus using the same.

2. Description of the Related Art

Generally, image forming apparatuses utilizing an electrophotographic system, such as printers, copying machines and fax machines, comprise: a photoreceptor as an image carrier; a charging device which uniformly charges the surface of the photoreceptor; an exposure device which generates an electrical image (electrostatic latent image) corresponding to an image on the surface of the photoreceptor; a developing device which develops the electrostatic latent image with a toner to form a toner image; and a transfer device which transfers the toner image onto a transfer paper. Such image forming apparatuses also comprise a fixation device for fusing the toner, which has been transferred onto this transfer paper, on the transfer paper.

The photoreceptors used in such image forming apparatuses vary depending on the concept of each apparatus; however, at present, with the exception of inorganic photoreceptors composed of Se, a-Si or the like used in large-scale machines and high-speed machines, organic photoreceptors (or OPC: organic photoconductors) in which an organic pigment is dispersed in a resin are widely used because of their excellent stability, cost and easy usability. These organic photoreceptors are generally of a negatively chargeable-type, while inorganic photoreceptors are of a positively chargeable-type. On reason for this is that, although hole transport materials having a good hole transport function have been developed for a long time in negatively-chargeable organic photoreceptors, few electron transport materials having good electron transport capability have been developed for positively-chargeable organic photoreceptors.

Meanwhile, in the negative charging process for the negatively-chargeable photoreceptors, since negative corona discharge generates a far greater amount of ozone than positive corona discharge, the generation of ozone is suppressed by adopting a contact charging system, such as roller charging or brush charging. However, contact charging systems are, as compared to positive-type non-contact charging systems, less favorable in terms of cost and also disadvantageous in terms of image quality improvement in that, for example, they are likely to cause contamination of charging members and thus unlikely to impart a photoreceptor with uniform surface potential.

In order to solve these problems, it is effective to apply a positively-chargeable organic photoreceptor and, therefore, there is thus a demand for a high-performance positively-chargeable organic photoreceptor. Positively-chargeable organic photoreceptors not only have the above-described benefits unique to the positive charging systems, but also are advantageous in that, since carrier generation generally takes place in the vicinity of the photosensitive layer surface, they have less lateral diffusion of carriers than negatively chargeable organic photoreceptors and thus exhibit superior dot reproducibility (resolution and gradation). Accordingly, positively-chargeable organic photoreceptors have been increasingly put on the market in various fields calling for improvement in image resolution.

As low-cost, small-sized, high-resolution and high-speed monochrome or color printers that take advantage of these merits, apparatuses employing a cleaner-less process of a non-magnetic single-component contact development system using a positively-chargeable polymerized toner are available and, their market has been growing since these apparatuses can yield images with high print quality.

In positively-chargeable organic photoreceptors, layer configurations are roughly classified into four types as described below, and a variety of layer configurations have been previously proposed. The first configuration is a two-layer configuration of a function-separated photoreceptor in which a charge transport layer and a charge generation layer are sequentially laminated on a conductive support (see, for example, Patent Document 1). The second configuration is a three-layer configuration of a function-separated photoreceptor in which a surface protective layer is laminated on the above-described two-layer configuration (see, for example, Patent Document 2). The third configuration is a two-layer configuration of a function-separated photoreceptor in which a charge generation layer and a charge (electron) transport layer are sequentially laminated in the reverse order to that of the first configuration (see, for example, Patent Document 3). The fourth configuration is of a single layer-type photoreceptor in which a charge generation material, a hole transport material and an electron transport material are dispersed in the same single layer (see, for example, Patent Document 3). It is noted here that the above-described 4-type classification does not take into account the presence or absence of an undercoat layer.

There among, single layer-type photoreceptors having the fourth configuration have been studied in detail and generally and widely put into practical use. However, since there are limitations in terms of achieving high sensitivity, high speed and high durability at the same time in single layer-type photoreceptors, novel laminate-type positively-chargeable photoreceptors in which a charge transport layer and a charge generation layer are sequentially laminated have been proposed as well (see, for example, Patent Document 4). The layer configurations of these laminate-type positively-chargeable photoreceptors are similar to the above-described layer configuration of the first type; however, in this layer configuration, not only the amount of a charge generation material contained in the charge generation layer can be reduced while incorporating an electron transport material and the thickness of the charge generation layer can be increased to be close to that of the underlying charge transport layer, but also the amount of a hole transport material to be incorporated into the charge generation layer can be reduced; therefore, the resin ratio in the charge generation layer can be set to be higher than that in a conventional single layer-type photoreceptor, and an increase in both sensitivity and durability can thus be easily achieved.

Further, Patent Document 5, aiming at providing an electrophotographic photoreceptor that has excellent electrical characteristics and is capable of effectively suppressing filming and black spot generation caused by filming under any use conditions, discloses a technology of arranging a photosensitive layer, which contains a hole transport agent, a charge transport agent, a charge generation agent and a binder resin, on a substrate and using specific compounds as a hole transport agent and a charge transport agent, and it is also disclosed therein that it is preferred to control the contact angle (measurement temperature: 25° C., measurement sample: pure water) of the photosensitive layer to be 95° or larger.

Related patent documents discussed herein include Patent Document 1: Japanese Patent Publication No. H05-30262; Patent Document 2: Japanese Patent Publication No. H05-47822; Patent Document 3: Japanese Unexamined Patent Application Publication No. H05-45915; Patent Document 4: Japanese Unexamined Patent Application Publication No. 2009-288569: and Patent Document 5: Japanese Unexamined Patent Application Publication No. 2008-197456.

However, when any of the above-described single layer-type positively-chargeable organic photoreceptors and laminate-type positively-chargeable organic photoreceptors is employed in the above-described cleaner-less process of a non-magnetic single-component contact development system using a polymerized toner, although a high image quality is attained, there is a problem that, in printing under a high-temperature and high-humidity environment, adhesion of a mixture of the toner and paper dust to the photoreceptor surface leads to deposition of the mixture on the photoreceptor surface, making the mixture unremovable.

In other words, in this case, during initial printing under a high-temperature and high-humidity environment, the deposits on the photoreceptor surface absorb the moisture in the air to cause a reduction in resistance directly underneath, and this leads to local reduction in potential and leakage, making black spots in a monochrome printer or color spots in a color printer more likely to be generated as fine image defects.

The mixture of the toner and paper dust is highly hygroscopic. Therefore, the deposits on the photosensitive layer surface continuously absorb moisture from the air and supply the moisture into the photosensitive layer. This causes the resistance of the parts of the photosensitive layer that are directly underneath the deposits to be considerably lower than that of other parts, and a loss in charge potential occurs on the blank portion (charged portion) during the printing due to local reduction in charge potential and leakage, as a result of which the toner is developed and black spots or color spots are thereby generated. Such black spots or color spots have a diameter of about 0.5 mm or less.

In this respect, conventionally, a measure for increasing the pressure resistance by any of the following methods is implemented. As one method, the photosensitive layer is made thicker than conventional photosensitive layers (e.g., a thickness of 20 to 30 μm is increased to a thickness of 31 to 40 μm). Further, the roughness of the substrate (conductive support) is reduced by changing the substrate processing conditions from machining to mirror finishing, or a resin film or an anodic oxide film is added as a barrier layer between the substrate and the photosensitive layer.

However, these methods do not drastically suppress deposition of the mixture of the toner and paper dust onto the photosensitive layer surface; therefore, the problem of fine black spot generation has not yet been resolved. Actually, this can also be perceived from the fact that, as shown in FIG. 4, the correlation between the pressure resistance of a photosensitive layer (leakage onset time) and the number of generated fine black spots is not necessarily clear.

Moreover, with regard to the deposits on the photoreceptor surface, there is a problem of toner filming in which the toner component adheres to the photoreceptor surface to form a thin film over a large area. In this respect, as in Patent Document 5, it is possible to adopt a technology of suppressing such filming and black spot generation caused by the filming by using specific hole transport agent and charge transport agent in the photosensitive layer and controlling the contact angle of the photosensitive layer to be 95° or larger; however, it is believed that such a large contact angle rather makes the above-described deposition of toner and paper dust more likely to occur. Therefore, it is demanded to establish a technology that is capable of eliminating both the generation of fine black spots caused by deposition of a mixture of toner and paper dust and the occurrence of toner filming.

In view of the above, an object of the present invention is to provide an electrophotographic photoreceptor which solves the above-described problems and, even when mounted on a high-image-quality monochrome high-speed printer or tandem color printer comprising a cleaner-less process of a non-magnetic single-component contact development system using a polymerized toner, inhibits the generation of fine black spots or color spots and suppresses the occurrence of toner filming during the initial printing under a high-temperature and high-humidity environment and thereby stably attains a high image quality in a variety of environments; a method for producing the same; and an electrophotographic apparatus using the same.

SUMMARY OF THE INVENTION

As a result of intensive studies on measures for preventing generation of fine black spots or color spots and occurrence of filming that are caused by deposition of a mixture of a toner and paper dust to the photoreceptor surface under a high-temperature and high-humidity environment, the present inventors discovered that the generation of fine black spots and the like and the occurrence of filming during initial printing under a high-temperature and high-humidity environment can both be suppressed by controlling the contact angle of the outermost layer surface of a photoreceptor to be in a prescribed range.

That is, the electrophotographic photoreceptor according to a first embodiment of the present invention is a positively-chargeable electrophotographic photoreceptor comprising: a conductive support; and a single layer-type photosensitive layer which contains a charge generation material, a hole transport material, an electron transport material and a binder resin and is arranged on the conductive support, wherein the charge generation material contains at least a titanyl phthalocyanine, and a contact angle between the surface of an outermost layer of the positively-chargeable electrophotographic photoreceptor and water is in a range of 81° to 87°.

Further, the electrophotographic photoreceptor according to a second embodiment of the present invention is a positively-chargeable electrophotographic photoreceptor comprising: a conductive support; a charge transport layer which contains at least a hole transport material and a binder resin and is arranged on the conductive support; and a charge generation layer which contains at least a charge generation material, a hole transport material, an electron transport material and a binder resin and is arranged on the charge transport layer, wherein a contact angle between the surface of an outermost layer of the positively-chargeable electrophotographic photoreceptor and water is in a range of 81° to 87°.

The charge generation material may contain at least a titanyl phthalocyanine.

The binder resin of the outermost layer may contain a resin having repeating units which is represented by Formula (1) below, or may contain a resin having repeating units which is represented by Formula (1) below, and a resin having repeating units which is represented by t Formula (2) below. Further, the binder resin of the outermost layer may contain a resin having repeating units which is represented by Formula (2) below, and a resin having repeating units which is represented by Formula (3) below:

(1)

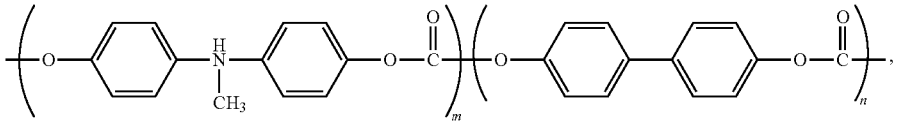

m/(m + n) = 0.6~0.9

(2)

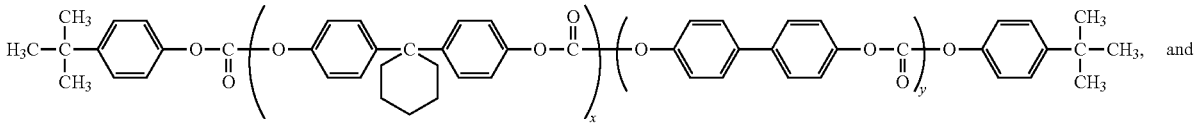

x/(x + y) = 0.6~0.9

(3)

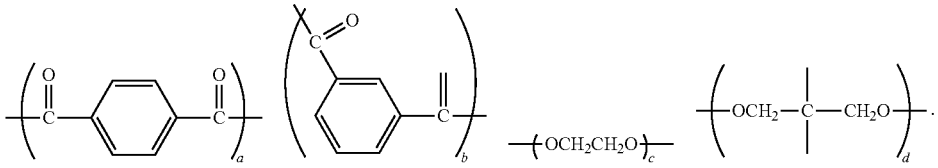

a + b + c + d = 100 mol %, |a + b| - |c + d| ≤ 1 mol %

The method for producing an electrophotographic photoreceptor according to a third embodiment of the present invention is a method for producing either of the above-described electrophotographic photoreceptors, wherein the outermost layer is formed by a dip coating method.

The electrophotographic apparatus according to a fourth embodiment of the present invention is equipped with either of the above-described electrophotographic photoreceptors.

The electrophotographic apparatus may comprise a cleaner-less process of a non-magnetic single-component contact development system using a polymerized toner.

According to the present invention, an electrophotographic photoreceptor which, even when mounted on a high-image-quality monochrome high-speed printer or tandem color printer comprising a cleaner-less process of a non-magnetic single-component contact development system using a polymerized toner, inhibits the generation of fine black spots or color spots and suppresses the occurrence of toner filming during the initial printing under a high-temperature and high-humidity environment and thereby stably attains a high image quality in a variety of environments; a method for producing the same; and an electrophotographic apparatus using the same can be realized.

DETAILED DESCRIPTION OF THE INVENTION

Figure 1:
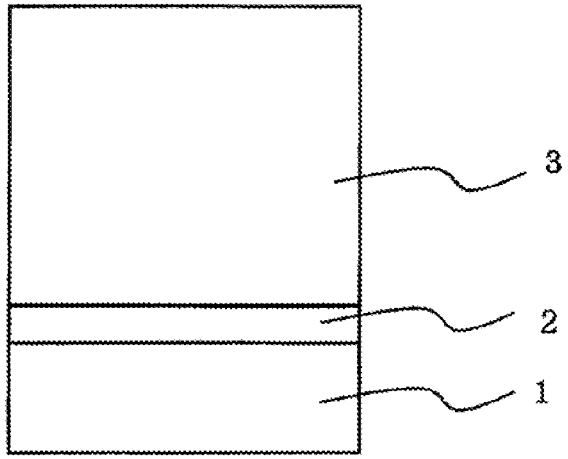
FIG. 1 is a schematic cross-sectional view showing one exemplary configuration of a single layer-type positively-chargeable electrophotographic photoreceptor according to the present invention.

Concrete embodiments of the present invention will now be described in detail referring to the drawings. The present invention, however, is not restricted to the following descriptions by any means.

Figure 2:
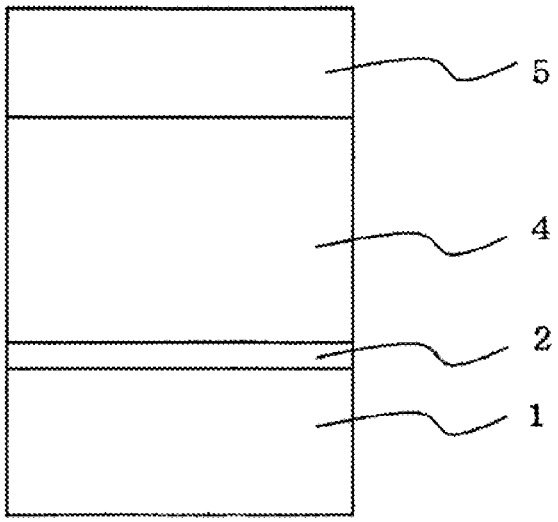
FIG. 2 is a schematic cross-sectional view showing one exemplary configuration of a laminate-type positively-chargeable electrophotographic according to the present invention.

FIGS. 1 and 2 are schematic cross-sectional views each showing one exemplary configuration of an electrophotographic photoreceptor according to the present invention. FIG. 1 shows a single layer-type positively-chargeable electrophotographic photoreceptor which comprises a single layer-type photosensitive layer 3 on a conductive support 1 via an undercoat layer 2, and FIG. 2 shows a laminate-type positively-chargeable electrophotographic photoreceptor which sequentially comprises a charge transport layer 4 and a charge generation layer 5 on the conductive support 1 via the undercoat layer 2.

In the electrophotographic photoreceptor of the present invention, regardless of whether it is a single layer-type or a laminate-type, a contact angle between the surface of an outermost layer and water is in a range of 81° to 87°, particularly preferably in a range of 82° to 86°. By controlling the contact angle of the outermost layer surface to be 87° or smaller, the moisture adsorbing to the photoreceptor is uniformly distributed on the surface of the photoreceptor and deposition of a mixture of a toner and paper dust can thereby be inhibited even in a high-temperature and high-humidity environment, so that the generation of fine black spots or color spots during initial printing can be suppressed. The reason for this is believed to be because aggregation of water, which serves as an origin of adhesion of foreign matters, can be inhibited by reducing the contact angle between the photoreceptor surface and water. Meanwhile, by controlling the contact angle of the outermost layer surface to be 81° or larger, not only the occurrence of toner filming on the photoreceptor surface that is associated with use but also the generation of black spots (fogging) caused by toner filming can be suppressed.

Figure 5:
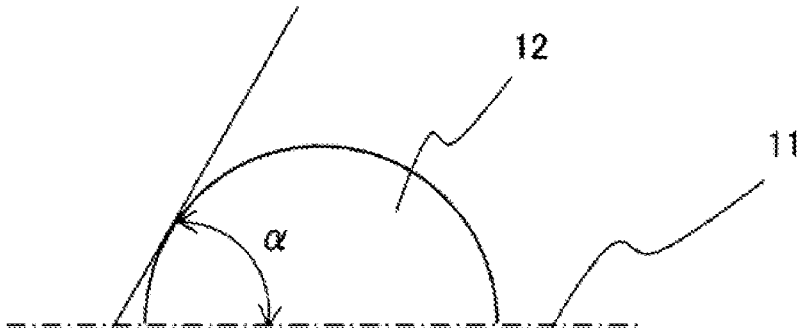
FIG. 5 is an explanatory view illustrating a contact angle between the surface of an outermost layer of a photoreceptor and water.

In the photoreceptor of the present invention, the term "contact angle between the surface of an outermost layer and water" means a contact angle measured using pure water under an environment of 25° C. and 50% RH. That is, as shown in FIG. 5, among those angles formed by the surface of pure water 12 and the surface of an outermost layer 11 of a photoreceptor when the pure water 12 is dropped onto the surface of the outermost layer 11, an angle α inside the pure water 12 is the contact angle between the surface of the outermost layer and water. This contact angle can be measured using, for example, a contact angle meter DM500 manufactured by Kyowa Interface Science Co., Ltd.

In the present invention, specifically, the surface contact angle can be adjusted by appropriately selecting one or more binder resins constituting the outermost layer. As the binder resins of the outermost layer used in the present invention, from the standpoints of the dispersion stability and mechanical strength of the charge generation material used in combination, it is preferred to use a polycarbonate-based resin such as a bisphenol A-type, bisphenol Z-type or bisphenol A-type biphenyl copolymer as an indispensable resin and to mix, as an optional resin, an appropriate amount of, for example, a polystyrene-based resin, a polyester-based resin, a polyarylate-based resin, a polyphenylene-based resin, a polyaryl resin, a polyurethane resin, and/or a polyethylene resin, so as to attain the desired contact angle. The contact angle can be reduced by increasing the amount of a bisphenol component.

As the polycarbonate-based resin, for example, a resin having repeating units which is represented by Formula (1) below can be suitably used, and it is preferred to use a combination of a resin having repeating units which is represented by the Formula (1) below and a resin having repeating units which is represented by Formula (2) below. Further, it is also preferred to use a combination of a polycarbonate-based resin having repeating units which is represented by the Formula (2) below, and a polyester resin having repeating units which is represented by Formula (3) below. It is noted here that the ratio between the resin having repeating units which is represented by the Formula (1) below and the resin having repeating units which is represented by the Formula (2) below is preferably 100:0 to 70:30, and this enables to attain a contact angle of 84.7° to 87.0°. Moreover, the ratio between the resin having repeating units which is represented by the Formula (2) below and the resin having repeating units which is represented by the Formula (3) below is preferably 52:48 to 91:9, and this enables to attain a contact angle of 81.0° to 87.0°. As long as the resins having the repeating units which are represented by the respective Formulae below are used, the contact angle value varies only about 0.3% within a range where the ratios of the respective repeating units satisfy: m(m+n)=0.6 to 0.9; x(x+y)=0.6 to 0.9; and a+b+c+d=100% by mole and |a+b|−|c+d|≤1% by mole:

(1)

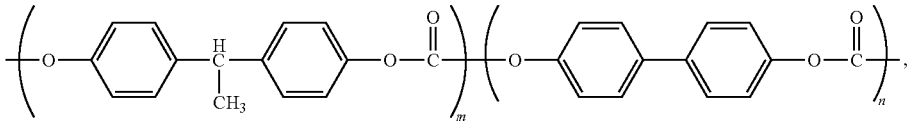

m/(m + n) = 0.6~0.9

(2)

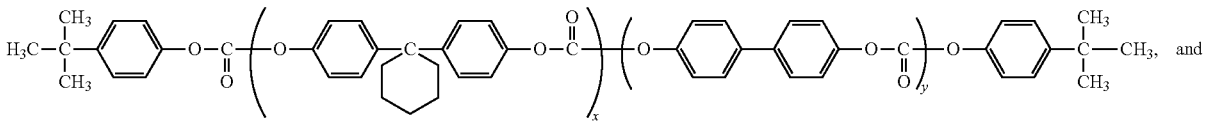

x/(x + y) = 0.6~0.9

(3)

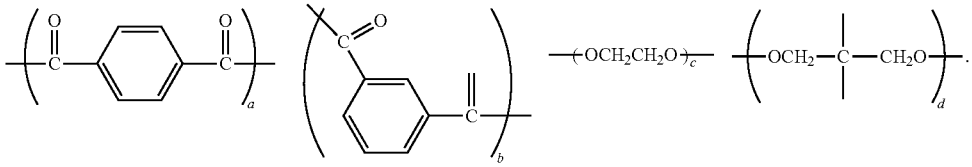

a + b + c + d = 100 mol %, |a + b| - |c + d| ≤ 1 mol %

Single Layer-Type Photoreceptor

Conductive Support

The conductive support 1 functions as an electrode of the photoreceptor and, at the same time, serves as a support of the layers constituting the photoreceptor. The conductive support 1 may take any form, such as a cylindrical form, a plate form or a film form, and the material of the conductive support 1 may be a metal (e.g., aluminum, stainless steel, or nickel), glass, a resin or the like, whose surface has been subjected to a conductive treatment.

Undercoat Layer

The undercoat layer 2 is basically not necessary in the present invention; however, it may be arranged as required for the purpose of further improving the reliability. The undercoat layer 2 is composed of a layer containing a resin as a main component, or a metal oxide coating film of alumite or the like, and it is arranged for the purposes of improving the adhesion between the conductive support and the charge transport layer and controlling the injectability of a charge into the photosensitive layer. Examples of a resin material used in the undercoat layer include insulating polymers, such as casein, polyvinyl alcohol, polyamide, melamine and cellulose; and conductive polymers, such as polythiophene, polypyrrole and polyaniline, and these resins may be used individually, or mixed in an appropriate combination. Further, a metal oxide, such as titanium dioxide or zinc oxide, may be incorporated into these resins.

Photosensitive Layer

The single layer-type photosensitive layer 3 is mainly composed of a charge generation material, a hole transport material, an electron transport material, and a binder resin. The single layer-type photosensitive layer 3 may be formed on the outer periphery of the electrophotographic photoreceptor and positioned farthest away from the conductive support 1. The electrophotographic photoreceptor may be mounted on an electrophotographic apparatus in a state where the surface of the photosensitive layer 3, which is positioned farthest away from the conductive support 1, can come into contact with the atmosphere.

Charge Generation Material

As the charge generation material, an X-type metal-free phthalocyanine by itself, or any one of or an appropriate combination of α-type titanyl phthalocyanine, β-type titanyl phthalocyanine, Y-type titanyl phthalocyanine, γ-type titanyl phthalocyanine, amorphous-type titanyl phthalocyanine and gallium phthalocyanine can be used, and a suitable substance can be selected in accordance with the light wavelength region of an exposure light source used for image formation. From the standpoint of enhancing the sensitivity, a titanyl phthalocyanine having high quantum efficiency is optimal.

Hole Transport Material

As the hole transport material, for example, various hydrazone compounds, styryl compounds, stilbene compounds, enamine compounds, diamine compounds, butadiene compounds, indole compounds, triphenylamine compounds, and triphenyldiamine compounds can be used individually, or in an appropriate combination. There among, a styryl compound containing a triphenylamine skeleton is preferred because of its cost and performance.

Electron Transport Material

As the electron transport material, a material with higher mobility is more preferred, and the electron transport material is preferably a quinone-based material (e.g., benzoquinone, stilbenequinone, naphthoquinone, dinaphthoquinone, diphenoquinone, phenanthrenequinone, or azoquinone) or a tetranaphthalene carboxylic acid diimide-based material. From the standpoints of the injectability into the charge transport layer and the compatibility with the binder resin, any of these materials may be used alone, and it is also preferred to use two or more thereof so as to increase the content of the charge transport material while inhibiting precipitation.

Binder Resin

As the binder resin, as described above, a variety of polycarbonate-based resins can be used as an indispensable resin and, in order to control the contact angle, an optional resin selected from polystyrene-based resins, polyester-based resins, polyarylate-based resins and the like may be used as appropriate in combination.

Other Additives

In the photosensitive layer 3, as desired, deterioration inhibitors such as an antioxidant and a light stabilizer may be incorporated for the purpose of improving the environmental resistance and the stability against damaging light. Examples of a compound used for such a purpose include chromanol derivatives such as tocopherol, as well as esterified compounds, polyarylalkane compounds, hydroquinone derivatives, etherified compounds, dietherified compounds, benzophenone derivatives, benzotriazole derivatives, thioether compounds, phenylenediamine derivatives, phosphonates, phosphites, phenolic compounds, hindered phenol compounds, and amine compounds.

Further, for the purposes of improving the leveling of the resulting film and imparting lubricity, a leveling agent such as a silicone oil or a fluorocarbon oil may also be incorporated. In addition, for the purposes of adjusting the film hardness, reducing the frictional coefficient, imparting lubricity and the like, fine particles of a metal oxide (e.g., silicon oxide (silica), titanium oxide, zinc oxide, calcium oxide, aluminum oxide (alumina), or zirconium oxide), a metal sulfate (e.g., barium sulfate or calcium sulfate) or a metal nitride (e.g., silicon nitride or aluminum nitride) may be incorporated as well. Moreover, as required, other known additive(s) may also be incorporated within a range that does not markedly impair the electrophotographic properties.

Composition

In the photosensitive layer 3, in order to attain desired characteristics, the mass ratio between the sum of the functional materials (charge generation material, electron transport material, and hole transport material) and the binder resin is set in a range of 45:55 to 55:45. When the mass ratio of the functional materials is higher than 55% by mass in the photosensitive layer, that is, when the amount of the binder resin is less than 45% by mass, not only the film reduction amount is increased and the durability is thus reduced, but also the creep strength is insufficient due to a decrease in the glass transition temperature and this makes toner filming as well as filming of external additives and paper dust more likely to occur, as a result of which the amount of fine black spots and the like that are generated by deposition of a mixture of a toner and paper dust under the subject high-temperature and high-humidity environment is increased. In addition, contamination of contact members (creep deformation) is more likely to occur, and contamination due to oils and fats such as grease and sebum contamination are also aggravated. Meanwhile, when the mass ratio of the functional materials is less than 45% by mass in the photosensitive layer 3, that is, when the amount of the binder resin is greater than 55% by mass, it is difficult to attain desired sensitivity characteristics, and the photoreceptor may thus not be suitable for practical use. Generally speaking, from the standpoint of inhibiting member contamination, oil/fat contamination and sebum contamination while ensuring durability, it is desired to set the binder resin ratio to be high.

The content ratio of the charge generation material is preferably 0.5 to 3% by mass, more preferably 0.8 to 1.8% by mass, with respect to the whole film. When the amount of the charge generation material is excessively small, the sensitivity characteristics are insufficient and interference fringes are more likely to be generated, whereas when the amount of the charge generation material is excessively large, the charging characteristics and the fatigue characteristics (stability in repeated use) are likely to be insufficient.

The mass ratio of the electron transport material and the hole transport material can be modified in a range of 1:1 to 1:4; however, generally, from the standpoint of the transport balance of holes and electrons, it is more preferred to use these materials in a range of 2:3 to 1:3 from the standpoints of sensitivity characteristics, charging characteristics and fatigue characteristics.

Solvent

Examples of a solvent used in the formation of the photosensitive layer 3 include halogenated hydrocarbons, such as dichloromethane, dichloroethane, chloroform, carbon tetrachloride, and chlorobenzene; ethers, such as dimethyl ether, diethyl ether, tetrahydrofuran, dioxane, dioxolane, ethylene glycol dimethyl ether, and diethylene glycol dimethyl ether; and ketones, such as acetone, methyl ethyl ketone and cyclohexanone, and the solvent can be selected as appropriate in accordance with the solubility, the liquid stability and the coating properties of various materials.

Layer Thickness

From the standpoint of ensuring practically effective performance, the thickness of the photosensitive layer 3 is in a range of preferably 15 to 40 μm, more preferably 20 to 35 μm, still more preferably 25 to 30 μm.

Laminate-Type Photoreceptor

Conductive Support

The conductive support 1 is the same as that of the single layer-type photoreceptor.

Undercoat Layer

The undercoat layer 2 is also the same as that of the single layer-type photoreceptor and is basically not necessary in the present invention; however, it may be appropriately arranged as required for the purpose of improving the reliability.

Charge Transport Layer

The charge transport layer 4 is mainly composed of a hole transport material and a binder resin.

Hole Transport Material

The hole transport material used in the charge transport layer 4 is the same as the one used in the single layer-type photoreceptor; however, from the standpoint of smooth charge transfer from the charge generation layer 5 to the charge transport layer 4, it is desired to use the same material as the one contained in the charge generation layer 5.

Binder Resin

The binder resin of the charge transport layer 4 can be the same as the one used in the single layer-type photoreceptor; however, while the charge transport layer 4 constitutes an inner layer and is thus not required to have much mechanical strength, it is required that the binder resin hardly elute when the charge generation layer 5 is applied thereon. From this standpoint, a resin that hardly elutes into a solvent of a coating solution used for the formation of the charge generation layer 5 is suitable, and it is preferred to use such a resin that also has a high molecular weight.

Other Additives

In the charge transport layer 4, as desired, deterioration inhibitors such as an antioxidant and a light stabilizer may be incorporated for the purpose of improving the environmental resistance and the stability against damaging light. Examples of a compound that can be used for such a purpose include the same compounds as those exemplified above for the single layer-type photosensitive layer.

Further, in the charge transport layer 4, for the purposes of improving the leveling of the resulting film and imparting lubricity, a leveling agent such as a silicone oil or a fluorocarbon oil may also be incorporated as in the single layer-type photosensitive layer. In addition, for the purposes of adjusting the film hardness, reducing the frictional coefficient, imparting lubricity and the like, fine particles of the same various metal oxides, metal sulfates and metal nitrides as those exemplified above for the single layer-type photosensitive layer may be incorporated as well. Moreover, as required, other known additive(s) may also be incorporated within a range that does not markedly impair the electrophotographic properties.

Composition

In the charge transport layer 4, the mass ratio of the hole transport material and the binder resin can be set in a range of 1:3 to 3:1 (25:75 to 75:25), preferably in a range of 7:13 to 13:7 (35:65 to 65:35). When the content of the hole transport material is less than 25% by mass in the charge transport layer 4, not only the transport function is generally insufficient and the residual potential thus increases, but also the environmental dependence of the potential of exposed part in an apparatus is increased and this consequently impairs the environmental stability of image quality; therefore, the photoreceptor may not be suitable for use. Meanwhile, when the content of the hole transport material is greater than 75% by mass in the charge transport layer 4, that is, when the content of the binder resin is less than 25% by mass in the charge transport layer 4, application of the charge generation layer 5 may cause an adverse effect of elution.

Solvent

Examples of a solvent used in the formation of the charge transport layer 4 include halogenated hydrocarbons, such as dichloromethane, dichloroethane, chloroform, carbon tetrachloride, and chlorobenzene; ethers, such as dimethyl ether, diethyl ether, tetrahydrofuran, dioxane, dioxolane, ethylene glycol dimethyl ether, and diethylene glycol dimethyl ether; and ketones, such as acetone, methyl ethyl ketone and cyclohexanone, and the solvent can be selected as appropriate in accordance with the solubility, the liquid stability and the coating properties of various materials.

Layer Thickness

The thickness of the charge transport layer 4 is determined taking into consideration the balance with the below-described charge generation layer 5; however, from the standpoint of ensuring practically effective performance, the thickness of the charge transport layer 4 is in a range of preferably 3 to 40 μm, more preferably 5 to 30 μm, still more preferably 7 to 20 μm.

Charge Generation Layer

The charge generation layer 5 is formed by a method that comprises, for example, applying a coating solution obtained by dispersing particles of a charge generation material in a binder resin in which a hole transport material and an electron transport material are dissolved. The charge generation layer 5 has a function of generating carriers upon receiving light, as well as a function of transporting generated electrons to the photoreceptor surface and holes to the charge transport layer 4. It is important that the charge generation layer 5 have not only a high carrier generation efficiency but also a property of injecting generated holes into the charge transport layer 4, and the charge generation layer 5 desirably shows little electric field dependence and exhibits good injection even in low electric fields. The charge generation layer 5 may be formed on the outer periphery of the electrophotographic photoreceptor and positioned farthest away from the conductive support 1. The charge transport layer 4 may be formed between the charge generation layer 5 and the conductive support 1. Further, the electrophotographic photoreceptor may be mounted on an electrophotographic apparatus in a state where the surface of the charge generation layer 5, which is positioned farthest away from the conductive support 1, can come into contact with the atmosphere.

Charge Generation Material

The charge generation material can be the same as the one used in the single layer-type photoreceptor, and a suitable substance can be selected in accordance with the light wavelength region of an exposure light source used for image formation. From the standpoint of enhancing the sensitivity, a titanyl phthalocyanine having high quantum efficiency is optimal.

Hole Transport Material

As for the hole transport material, since holes need to be injected into the charge transport layer 4, the difference in ionization potential between the hole transport material and the hole transport material of the charge transport layer 4 is preferably small, specifically 0.5 eV or less. Particularly, in the present invention, the charge generation layer 5 is coat-formed on the charge transport layer 4; therefore, in order to suppress the effect of elution of the charge transport layer 4 into the coating solution and to stabilize the liquid state of the charge generation layer 5 at the time of applying the charge generation layer 5, it is preferred that the hole transport material contained in the charge transport layer 4 be also contained in the charge generation layer 5, and it is more preferred to use the same hole transport material in both the charge transport layer 4 and the charge generation layer 5.

Electron Transport Material

The electron transport material can be the same as the one used in the single layer-type photoreceptor, a material with higher mobility is more preferred; however, from the standpoints of the injectability into the charge transport layer 4 and the compatibility with the binder resin, a single material may be used alone, and it is also preferred to use two or more materials so as to increase the content of the electron transport material while inhibiting precipitation.

Binder Resin

As the binder resin of the charge generation layer 5, as in the case of the single layer-type photoreceptor, a variety of polycarbonate-based resins can be used as an indispensable resin and, in order to control the contact angle, an optional resin selected from polystyrene-based resins, polyester-based resins, polyarylate-based resins and the like may be used as appropriate in combination. Particularly, in the same manner as the above-described hole transport material, in order to suppress the effect of elution of the charge transport layer 4 into the coating solution and to stabilize the liquid state of the charge generation layer 5 at the time of applying the charge generation layer 5, it is preferred that the binder resin contained in the charge transport layer 4 be also contained in the charge generation layer 5, and it is more preferred to use the same binder resin in both the charge transport layer 4 and the charge generation layer 5.

Other Additives

In the charge generation layer 5, as desired, deterioration inhibitors such as an antioxidant and a light stabilizer may be incorporated for the purpose of improving the environmental resistance and the stability against damaging light. Examples of a compound that can be used for such a purpose include the same compounds as those exemplified above for the single layer-type photosensitive layer.

Further, in the charge generation layer 5, for the purposes of improving the leveling of the resulting film and imparting lubricity, a leveling agent such as a silicone oil or a fluorocarbon oil may also be incorporated as in the single layer-type photosensitive layer. In addition, for the purposes of adjusting the film hardness, reducing the frictional coefficient, imparting lubricity and the like, fine particles of the same various metal oxides, metal sulfates and metal nitrides as those exemplified above for the single layer-type photosensitive layer may be incorporated as well. Moreover, as required, other known additive(s) may also be incorporated within a range that does not markedly impair the electrophotographic properties.

Composition

The amounts of the respective functional materials (charge generation material, electron transport material, and hole transport material) to be incorporated into the charge generation layer 5 are set as follows. First, in the present invention, the content of the charge generation material in the charge generation layer 5 is preferably 1 to 3.0% by mass, particularly preferably 1.5 to 2.5% by mass. Further, in the charge generation layer 5, in order to attain desired characteristics, the mass ratio between the sum of the functional materials (charge generation material, electron transport material, and hole transport material) and the binder resin is set in a range of 35:65 to 65:35 as in the case of the single layer-type photoreceptor. When the mass ratio of the functional materials is higher than 65% by mass in the charge generation layer 5, that is, when the amount of the binder resin is less than 35% by mass, not only the film reduction amount is increased and the durability is thus reduced, but also the creep strength is insufficient due to a decrease in the glass transition temperature and this makes toner filming as well as filming of external additives and paper dust more likely to occur, as a result of which the amount of fine black spots and the like that are generated by deposition of a mixture of a toner and paper dust in the subject high-temperature and high-humidity environment is increased. In addition, contamination of contact members (creep deformation) is more likely to occur, and contamination due to oils and fats such as grease and sebum contamination are also aggravated. Meanwhile, when the mass ratio of the functional materials is less than 35% by mass in the charge generation layer 5, that is, when the amount of the binder resin is greater than 65% by mass, it is difficult to attain desired sensitivity characteristics, and the photoreceptor may thus not be suitable for practical use. Generally speaking, from the standpoint of inhibiting member contamination, oil/fat contamination and sebum contamination while ensuring durability, it is desired to set the binder resin ratio to be high.

The mass ratio of the electron transport material and the hole transport material can be modified in a range of 1:5 to 5:1. However, in the present invention, the charge transport layer 4 having a hole transport function exists under the charge generation layer 5; therefore, contrary to the hole transport material-rich composition of a single layer-type organic photoreceptor in which the above-described mass ratio is generally in a range of 1:5 to 2:4, the mass ratio is preferably in a range of 5:1 to 4:2, particularly preferably in a range of 4:1 to 3:2 from the standpoint of overall characteristics. In this manner, in the laminate-type photoreceptor of the present invention, since a large amount of the hole transport material can be incorporated into the charge transport layer 4 constituting a lower layer, the laminate-type photoreceptor of the present invention has a characteristic feature in that, unlike the case of the single layer-type photoreceptor, the content of the hole transport material, which is a factor for crack generation caused by sebum adhesion, can be kept low in the charge generation layer 5 constituting an upper layer.

Solvent

Examples of a solvent used for the formation of the charge generation layer 5 include halogenated hydrocarbons, such as dichloromethane, dichloroethane, chloroform, carbon tetrachloride, and chlorobenzene; ethers, such as dimethyl ether, diethyl ether, tetrahydrofuran, dioxane, dioxolane, ethylene glycol dimethyl ether, and diethylene glycol dimethyl ether; and ketones, such as acetone, methyl ethyl ketone, and cyclohexanone. There among, those solvents having a high boiling point are generally preferred and, specifically, it is preferred to use a solvent having a boiling point of 60° C. or higher, particularly preferably a solvent having a boiling point of 80° C. or higher. Among such solvents, in cases where a titanyl phthalocyanine having high quantum efficiency is used as the charge generation material so as to enhance the sensitivity, it is preferred to employ 1,2-dichloroethane having a specific gravity of 1 or higher and a boiling point of 70° C. or higher as the solvent used in the formation of the charge generation layer from the standpoints of dispersion stability and unlikelihood of causing elution of the resulting charge transport layer.

Layer Thickness

The thickness of the charge generation layer 5 is determined taking into consideration its balance with the charge transport layer 4; however, from the standpoint of ensuring practically effective performance, the thickness of the charge generation layer 5 is in a range of preferably 3 μm to 40 μm, more preferably 5 μm to 30 μm, still more preferably 10 μm to 18 μm.

Method for Producing Photoreceptor

In the production of the photoreceptor of the present invention, the above-described outermost layer is formed by a dip coating method. By employing a dip coating method, a photoreceptor having good outer appearance quality and stable electrical characteristics can be produced while ensuring a low cost and a high productivity. The outermost layer is the single layer-type photosensitive layer 3 in the case of the single layer-type photoreceptor, or the charge generation layer 5 in the case of the laminate-type photoreceptor. In the production of the photoreceptor of the present invention, there is no particular restriction except for the use of a dip coating method, and the production can be carried out in accordance with a conventional method.

Electrophotographic Apparatus

The electrophotographic apparatus of the present invention is equipped with the above-described photoreceptor and, particularly, the electrophotographic apparatus of the present invention is suitably applied to a high-image-quality monochrome high-speed printer or tandem color printer (e.g., a printer having a printing rate of about 40 ppm or faster for A4-size paper) which comprises a cleaner-less process of a non-magnetic single-component contact development system using a polymerized toner.

Specifically, the electrophotographic apparatus of the present invention is suitable as an electrophotographic apparatus that employs a charging process of a non-contact charging system using a scorotron, namely a process of a non-magnetic single-component contact development system in which, because of high transfer efficiency, a paper dust collecting section collects only paper dust and untransferred toner is recycled in a developing section. In this case, because of the absence of a rubbing member that renews the surface of the photosensitive layer, the abrasion loss of the photosensitive layer is small and thus, particularly, a charge-free substance that has once adhered thereto is unlikely to be removed; therefore, in this process, when a mixture of a toner and paper dust adheres to the photosensitive layer surface under a high-temperature and high-humidity environment, the mixture is likely to be deposited.

Figure 3:
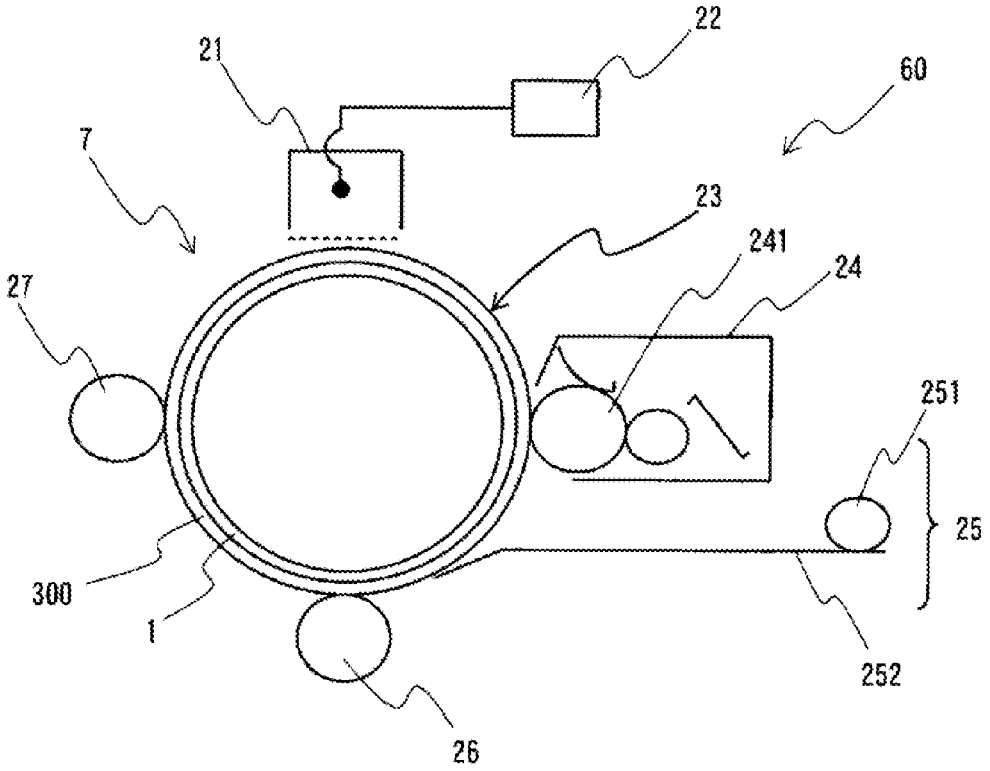
FIG. 3 is a schematic structural view showing one example of an electrophotographic apparatus according to the present invention.
Figure 4:
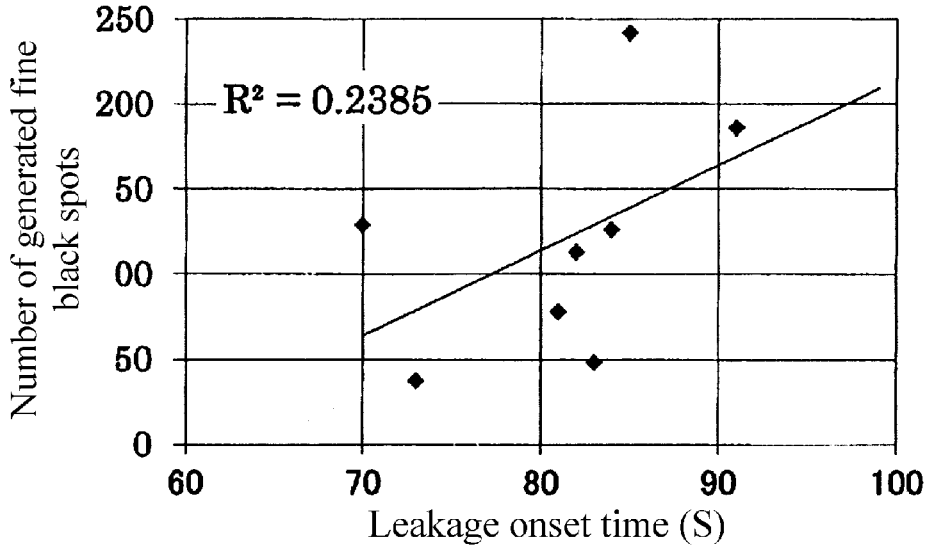
FIG. 4 is a graph showing the relationship between the leakage onset time and the number of generated fine black spots.

As one example, FIG. 3 shows a schematic structural view of one example of the electrophotographic apparatus according to the present invention. As illustrated, an electrophotographic apparatus 60 is equipped with an electrophotographic photoreceptor 7, which comprises: a conductive support 1; and a photosensitive layer 300 covering the outer periphery of the conductive support 1. More particularly, the illustrated electrophotographic apparatus 60 comprises: a charger 21 such as a roller charging member, which is arranged on the outer periphery of the photoreceptor 7; a high-voltage power source 22 which supplies an applied voltage to the charger 21; an image exposure member 23; a developer 24 equipped with a developing roller 241; a paper-feeding member 25 equipped with a paper-feeding roller 251 and a paper feed guide 252; a transfer charger (direct charging-type) 26; and a paper dust collecting section 27, and can be configured as a color printer.

EXAMPLES

Concrete embodiments of the present invention will now be described in more detail by way of examples thereof. The present invention, however, is not restricted to the following Examples as long as they do not deviate from the gist of the present invention.

Production Examples of Electrophotographic Photoreceptors

As conductive supports, 0.75 mm-thick aluminum tubes machined to have a surface roughness (Rmax) of 0.2 μm in two different shapes of φ30 mm×244.5 mm (length) and φ30 mm×254.4 mm (length) were used.

Materials Used

Charge Generation Material

As a charge generation material, a titanyl phthalocyanine G1 represented by Formula below was used:

G1

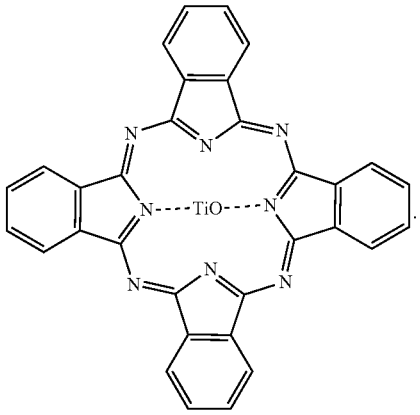

Hole Transport Materials

As hole transport materials, Compounds H1, H2 and H3 below were used:

H1

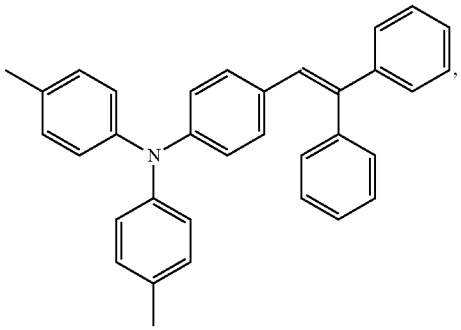

H2

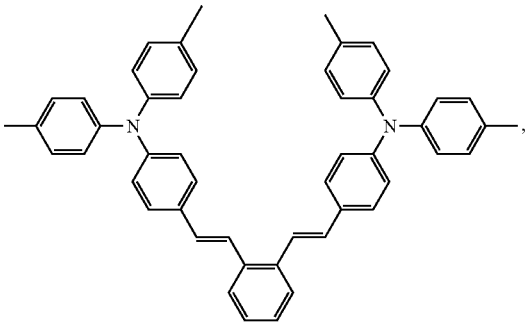

and

H3

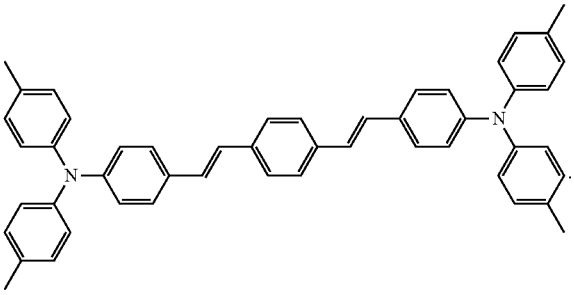

Electron Transport Materials

As electron transport materials, Compounds E1, E2 and E3 below were used:

E1

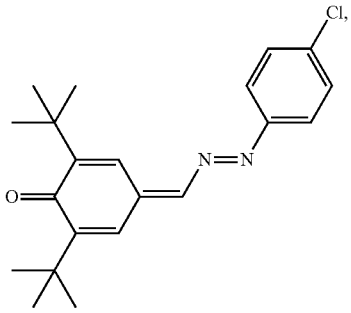

E2

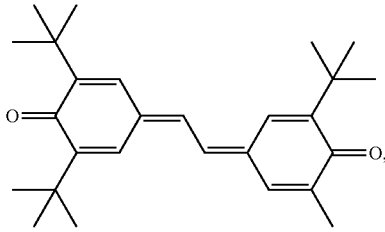

and

E3

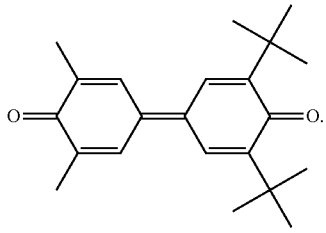

Binder Resins

As binder resins, polycarbonate-based resins B1 to B6 each having a repeating unit(s), which are represented by respective formulae below, were used:

B1: polycarbonate-based resin

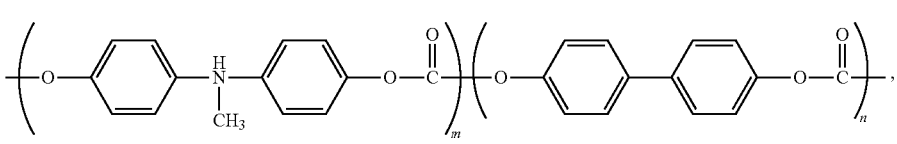

(1)

m/(m + n) = 0.85

B2: polycarbonate-based resin

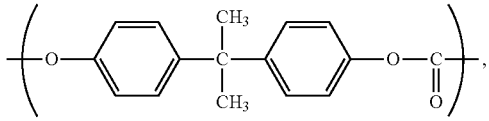

B3: polycarbonate-based resin

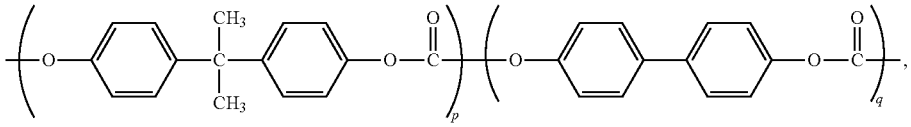

p/(p + q) = 0.85

B4: polycarbonate-based resin

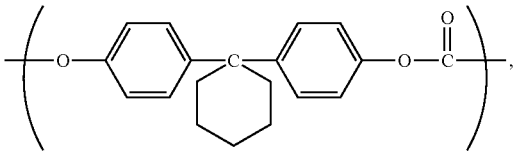

B5: polycarbonate-based resin

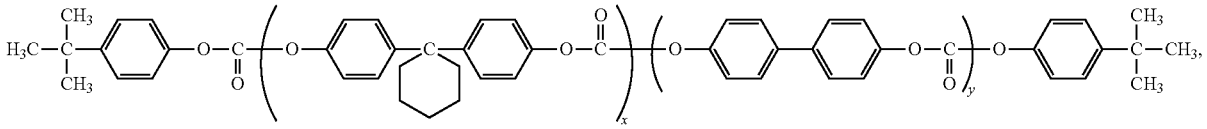

x/(x + y) = 0.85 and

B6: polycarbonate-based resin

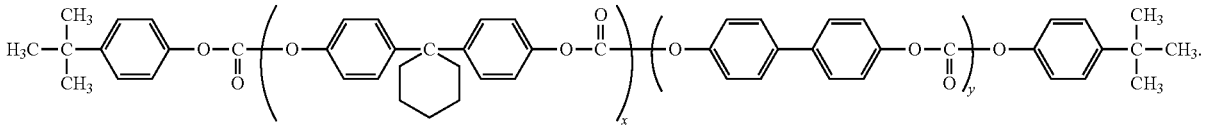

x/(x + y) = 0.60

Further, as optional binder resins used in combination with one of the above-described polycarbonate-based resins B1 to B6, the following resins B7 to B9 were used:

B7: general-purpose polystyrene resin, GPPS manufactured by Toyo Engineering Corporation;

B8: high-molecular-weight polyester resin having the following repeating units:

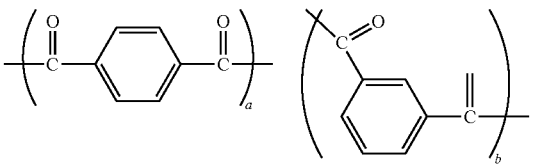

-continued

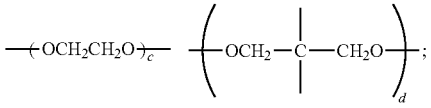

a ≈ b ≈ c ≈ d ≈ 25% by mol and x/(x + y) = 0.60

B9: general-purpose polyarylate resin, U-POLYMER manufactured by Unitika Ltd.

Additives

As an antioxidant, a hindered phenol-based antioxidant, dibutylhydroxytoluene (BHT), was used.

As a lubricant, a dimethyl silicone oil KF-54 manufactured by Shin-Etsu Chemical Co., Ltd. was used.

Solvent

As a solvent, tetrahydrofuran was used.

Preparation of Coating Solutions

Coating Solutions for Single Layer-Type Photoreceptor

Each of the above-described hole transport materials, electron transport materials, binder resins and additives were added to a vessel along with the solvent at a prescribed mixing ratio, and the added materials were dissolved. Subsequently, the above-described charge generation material weighed to have a prescribed mass ratio was added and then dispersed using a DYNO-MILL (MULTILAB, manufactured by Shinmaru Enterprises Corporation), whereby each coating solution for single layer-type photoreceptor was prepared.

The composition ratios of the materials other than the binder resin(s) are shown in Table 1 below. In Table 1, "content" indicates "% by mass".

TABLE 1

| Material | Charge generation material | | Electron transport material | | Hole transport material | | Resin | Additive | |
|---|---|---|---|---|---|---|---|---|---|
| composition name | Material | Content | Material | Content | Material | Content | total | BHT | KF54 |
| Single-layer GT1 | G1 | 1.8 | E3 | 10.8 | H3 | 32.3 | 55 | 0.1 | 0.1 |
| Single-layer GT2 | G1 | 0.8 | E1 | 21.6 | H1 | 32.4 | 45 | 0.1 | 0.1 |
| Single-layer GT3 | G1 | 1.3 | E2 | 15.8 | H2 | 32.7 | 50 | 0.1 | 0.1 |

Coating Solutions for Laminate-Type Photoreceptor

"Coating Solutions for Charge Transport Layer"

Each of the above-described hole transport materials, binder resins and additives were added to a vessel along with the solvent at a prescribed mixing ratio, and the added materials were dissolved, whereby each coating solution for charge transport layer of laminate-type photoreceptor was prepared.

The composition ratios of the materials other than the binder resin are shown in Table 2 below. In Table 2, "content" indicates "% by mass". As the binder resin, the above-described resin B5 was used.

TABLE 2

| Material composition | Hole transport material | | | Additive | |
|---|---|---|---|---|---|
| name | Material | Content | Resin total | BHT | KF54 |
| Laminate CT1 | H1 | 64.8 | 35 | 0.1 | 0.1 |
| Laminate CT2 | H2 | 49.8 | 50 | 0.1 | 0.1 |
| Laminate CT3 | H3 | 34.8 | 65 | 0.1 | 0.1 |

Coating Solutions for Charge Generation Layer

Each of the above-described hole transport materials, electron transport materials, binder resins and additives were added to a vessel along with the solvent at a prescribed mixing ratio, and the added materials were dissolved. Subsequently, the above-described charge generation material weighed to have a prescribed weight ratio was added and then dispersed using a DYNO-MILL (MULTILAB, manufactured by Shinmaru Enterprises Corporation), whereby each coating solution for charge generation layer of laminate-type photoreceptor was prepared The composition ratios of the materials other than the binder resin(s) are shown in Table 3 below. In Table 3, "content" indicates "% by mass".

TABLE 3

| Material | Charge generation material | | Electron transport material | | Hole transport material | | Resin | Additive | |
|---|---|---|---|---|---|---|---|---|---|
| composition name | Material | Content | Material | Content | Material | Content | total | BHT | KF54 |
| Laminate G1 | G1 | 2.5 | E3 | 19.4 | H3 | 12.9 | 65 | 0.1 | 0.1 |
| Laminate G2 | G1 | 1.5 | E1 | 42.6 | H1 | 10.7 | 45 | 0.1 | 0.1 |
| Laminate G3 | G1 | 2.0 | E2 | 35.0 | H2 | 12.8 | 50 | 0.1 | 0.1 |

Production of Photoreceptors

Single Layer-Type Photoreceptors

The above-described conductive support was dip-coated with each of the above-prepared coating solutions for single layer-type photoreceptor, which had the material composition GT1 shown in Table 1 above and in which the binder resin(s) was/were changed as shown in Tables 4 to 7 below. The thus coated conductive supports were each dried with hot air at 110° C. for 60 minutes to form a 20 to 30 μm-thick single layer-type photosensitive layer, whereby single layer-type photoreceptors were produced. The thickness of the single layer-type photosensitive layer was 30 μm in Examples 1 to 18 and Comparative Examples 1 to 63, 25 μm in Examples 19 and 47, and 20 μm in Examples 20 and 48.

Further, the above-described conductive support was dip-coated with each of the above-prepared coating solutions for single layer-type photoreceptor, which had the material composition GT2 or GT3 shown in Table 1 above and in which the binder resin was changed as shown in Examples 21 and 22 of Table 7 below. The thus coated conductive supports were each dried with hot air at 110° C. for 60 minutes to form a 30 μm-thick single layer-type photosensitive layer, whereby single layer-type photoreceptors were produced.

Laminate-Type Photoreceptors

The above-described conductive support was dip-coated with the above-prepared coating solution for charge transport layer which had the material composition CT1 shown in Table 2 above, and the thus coated conductive support was dried with hot air at 110° C. for 60 minutes to form three types of charge transport layers having a thickness of 7 μm, 15 μm or 20 μm. Next, the resultants were each dip-coated with each of the above-prepared coating solutions for charge generation layer, which had the material composition G1 shown in Table 3 above and in which the binder resin(s) was/were changed as shown in Tables 8 to 11 below, and subsequently dried with hot air at 110° C. for 60 minutes to form three types of charge generation layers having a thickness of 10 μm, 15 μm or 18 μm, whereby laminate-type photoreceptors each having a total layer thickness of 17 μm, 30 μm or 38 μm were produced.

The total layer thickness was 30 μm in Examples 23 to 40 and Comparative Examples 64 to 126, 38 μm in Examples 41 and 49, and 17 μm in Examples 42 and 50.

Further, the above-described conductive support was dip-coated with the above-prepared coating solution for charge transport layer which had the material composition CT1 shown in Table 2 above, and the thus coated conductive support was dried with hot air at 110° C. for 60 minutes to form a 15 μm-thick charge transport layer. Thereafter, the resultant was dip-coated with each of the above-prepared coating solutions for charge generation layer, which had the material composition G2 or G3 instead of the material composition G1 shown in Table 3 above and in which the binder resin was changed as shown in Examples of 43 and 44 of Table 11 below, and subsequently dried with hot air at 110° C. for 60 minutes to form a 15 μm-thick charge generation layer, whereby laminate-type photoreceptors each having a total layer thickness of 30 μm were produced.

Moreover, the above-described conductive support was dip-coated with each of the above-prepared coating solutions for charge transport layer, which had the material composition CT2 or CT3 instead of the material composition CT1 shown in Table 2 above, and the thus coated conductive support was dried with hot air at 110° C. for 60 minutes to form a 15 μm-thick charge transport layer. Thereafter, the resultant was dip-coated with each of the above-prepared coating solutions for charge generation layer, which had the material composition G1 shown in Table 3 above and in which the binder resin was changed as shown in Examples 45 and 46 of Table 11 below, and subsequently dried with hot air at 110° C. for 60 minutes to form a 15 μm-thick charge transport layer, whereby laminate-type photoreceptors each having a total layer thickness of 30 μm were produced.

Photoreceptor Evaluation Methods

For the photoreceptors having a shape of φ30 mm×244.5 mm (length), each photoreceptor was integrated into a commercially available 50-ppm monochrome high-speed laser printer (HL-6400DW) manufactured by Brother Industries, Ltd., and up to 60,000 prints of an image having a print area ratio of 4% were intermittently made at 10-second intervals and a rate of 5,000 prints/day under an environment of 32° C. and 80% RH. The state of occurrence of filming was checked after the printing, and the generation state of fine black spots on a blank image was checked first thing in the following morning.

For the photoreceptors having a shape of φ30 mm×254.4 mm (length), each photoreceptor was integrated into a commercially available 22-ppm tandem color LED (HL-3170CDW) manufactured by Brother Industries, Ltd., and up to 15,000 prints of a color image having a print area ratio of 4% were intermittently made at 10-second intervals and a rate of 3,000 prints/day under an environment of 32° C. and 80% RH. The state of occurrence of filming was checked after the printing, and the generation state of color spots on a blank image was checked first thing in the following morning.

Evaluation Items of Photoreceptors

Measurement of Contact Angle of Photoreceptor Surface

The contact angle between the surface of the outermost layer of each photoreceptor produced above and water was measured by a contact angle meter DM500 manufactured by Kyowa Interface Science Co., Ltd. using pure water under an environment of 25° C. and 50% RH.

Evaluation of Generation State of Black Spots or Color Spots

For fine black spots or color spots on a blank portion (for those spots having a diameter of about 0.5 mm or smaller), the number of spots generated in a photoreceptor cycle was measured and evaluated on the following three scales.

○: 5 spots or less

Δ: 6 to 20 spots x: 21 spots or more

Evaluation of State of Occurrence of Filming

The state of occurrence of filming on the photoreceptor surface after the printing was visually checked and evaluated on the following three scales.

○: No toner deposition on the photoreceptor surface was observed before and after the printing.

Δ: Toner deposition in a sparsely spotted form was observed before and after the printing.

x: The toner deposition in a striped form along the circumferential direction was observed before and after the printing.

The results of these evaluations are altogether shown in Tables 4 to 11 below.

TABLE 4

| | First binder resin | | Second binder resin | | Contact | Monochrome printer | | Color printer | | Single layer |
|---|---|---|---|---|---|---|---|---|---|---|
| | Material | Content (% by mass) | Material | Content (% by mass) | angle (°) | Black spot | Filming | Color spot | Filming | thickness (μm) |
| Example 1 | B1 | 100 | — | — | 84.7 | ○ | ○ | ○ | ○ | 30 |
| Comparative Example 1 | B2 | 100 | — | — | 88.0 | x | ○ | x | ○ | 30 |
| Comparative Example 2 | B3 | 100 | — | — | 88.9 | Δ | ○ | Δ | ○ | 30 |
| Comparative Example 3 | B4 | 100 | — | — | 87.5 | Δ | ○ | Δ | ○ | 30 |
| Comparative Example 4 | B5 | 100 | — | — | 89.5 | x | ○ | x | ○ | 30 |
| Comparative Example 5 | B6 | 100 | — | — | 87.9 | Δ | ○ | Δ | ○ | 30 |
| Comparative Example 6 | B7 | 100 | — | — | 77.3 | ○ | x | ○ | x | 30 |
| Comparative Example 7 | B8 | 100 | — | — | 73.5 | ○ | x | ○ | x | 30 |
| Comparative Example 8 | B9 | 100 | — | — | 80.3 | ○ | x | ○ | x | 30 |
| Example 2 | B1 | 90 | B2 | 10 | 85.0 | ○ | ○ | ○ | ○ | 30 |
| Example 3 | B1 | 90 | B3 | 10 | 85.1 | ○ | ○ | ○ | ○ | 30 |
| Example 4 | B1 | 90 | B4 | 10 | 85.0 | ○ | ○ | ○ | ○ | 30 |
| Example 5 | B1 | 90 | B5 | 10 | 85.2 | ○ | ○ | ○ | ○ | 30 |
| Example 6 | B1 | 90 | B6 | 10 | 85.0 | ○ | ○ | ○ | ○ | 30 |
| Example 7 | B1 | 90 | B7 | 10 | 84.0 | ○ | ○ | ○ | ○ | 30 |

TABLE 4-continued

| | First binder resin | | Second binder resin | | Contact | Monochrome printer | | Color printer | | Single layer |
|---|---|---|---|---|---|---|---|---|---|---|
| | Material | Content (% by mass) | Material | Content (% by mass) | angle (°) | Black spot | Filming | Color spot | Filming | thickness (μm) |
| Example 8 | B1 | 90 | B8 | 10 | 83.6 | ○ | ○ | ○ | ○ | 30 |
| Example 9 | B1 | 90 | B9 | 10 | 84.3 | ○ | ○ | ○ | ○ | 30 |
| Comparative Example 9 | B2 | 90 | B1 | 10 | 87.7 | Δ | ○ | Δ | ○ | 30 |
| Comparative Example 10 | B2 | 90 | B3 | 10 | 88.1 | Δ | ○ | Δ | ○ | 30 |
| Comparative Example 11 | B2 | 90 | B4 | 10 | 88.0 | Δ | ○ | Δ | ○ | 30 |
| Comparative Example 12 | B2 | 90 | B5 | 10 | 88.2 | Δ | ○ | Δ | ○ | 30 |
| Comparative Example 13 | B2 | 90 | B6 | 10 | 88.0 | Δ | ○ | Δ | ○ | 30 |
| Example 10 | B2 | 90 | B7 | 10 | 86.9 | ○ | ○ | ○ | ○ | 30 |
| Example 11 | B2 | 90 | B8 | 10 | 86.6 | ○ | ○ | ○ | ○ | 30 |
| Comparative Example 14 | B2 | 90 | B9 | 10 | 87.2 | Δ | ○ | Δ | ○ | 30 |

TABLE 5

| | First binder resin | | Second binder resin | | Contact | Monochrome printer | | Color printer | | Single layer |
|---|---|---|---|---|---|---|---|---|---|---|
| | Material | Content (% by mass) | Material | Content (% by mass) | angle (°) | Black spot | Filming | Color spot | Filming | thickness (μm) |
| Comparative Example 15 | B3 | 90 | B1 | 10 | 88.5 | x | ○ | x | ○ | 30 |
| Comparative Example 16 | B3 | 90 | B2 | 10 | 88.8 | x | ○ | x | ○ | 30 |
| Comparative Example 17 | B3 | 90 | B4 | 10 | 88.8 | x | ○ | x | ○ | 30 |
| Comparative Example 18 | B3 | 90 | B5 | 10 | 89.0 | x | ○ | x | ○ | 30 |
| Comparative Example 19 | B3 | 90 | B6 | 10 | 88.8 | x | ○ | x | ○ | 30 |
| Comparative Example 20 | B3 | 90 | B7 | 10 | 87.7 | Δ | ○ | Δ | ○ | 30 |
| Comparative Example 21 | B3 | 90 | B8 | 10 | 87.4 | Δ | ○ | Δ | ○ | 30 |
| Example 12 | B3 | 90 | B9 | 10 | 86.5 | ○ | ○ | ○ | ○ | 30 |
| Example 13 | B4 | 90 | B1 | 10 | 86.5 | ○ | ○ | ○ | ○ | 30 |
| Comparative Example 22 | B4 | 90 | B2 | 10 | 87.6 | Δ | ○ | Δ | ○ | 30 |
| Comparative Example 23 | B4 | 90 | B3 | 10 | 87.6 | Δ | ○ | Δ | ○ | 30 |
| Comparative Example 24 | B4 | 90 | B5 | 10 | 87.7 | Δ | ○ | Δ | ○ | 30 |
| Comparative Example 25 | B4 | 90 | B6 | 10 | 87.5 | Δ | ○ | Δ | ○ | 30 |
| Example 14 | B4 | 90 | B7 | 10 | 86.5 | ○ | ○ | ○ | ○ | 30 |
| Example 15 | B4 | 90 | B8 | 10 | 86.1 | ○ | ○ | ○ | ○ | 30 |
| Example 16 | B4 | 90 | B9 | 10 | 86.6 | ○ | ○ | ○ | ○ | 30 |
| Comparative Example 26 | B5 | 90 | B1 | 10 | 89.0 | Δ | ○ | Δ | ○ | 30 |
| Comparative Example 27 | B5 | 90 | B2 | 10 | 89.4 | x | ○ | x | ○ | 30 |
| Comparative Example 28 | B5 | 90 | B3 | 10 | 89.4 | x | ○ | x | ○ | 30 |
| Comparative Example 29 | B5 | 90 | B4 | 10 | 89.3 | x | ○ | x | ○ | 30 |
| Comparative Example 30 | B5 | 90 | B6 | 10 | 89.3 | x | ○ | x | ○ | 30 |
| Comparative Example 31 | B5 | 90 | B7 | 10 | 88.3 | Δ | ○ | Δ | ○ | 30 |
| Comparative Example 32 | B5 | 90 | B8 | 10 | 87.9 | Δ | ○ | Δ | ○ | 30 |
| Comparative Example 33 | B5 | 90 | B9 | 10 | 88.6 | Δ | ○ | Δ | ○ | 30 |

TABLE 6

| | First binder resin | | Second binder resin | | Contact | Monochrome printer | | Color printer | | Single layer |
|---|---|---|---|---|---|---|---|---|---|---|
| | Material | Content (% by mass) | Material | Content (% by mass) | angle (°) | Black spot | Filming | Color spot | Filming | thickness (μm) |
| Comparative Example 34 | B6 | 90 | B1 | 10 | 87.6 | Δ | ○ | Δ | ○ | 30 |
| Comparative Example 35 | B6 | 90 | B2 | 10 | 87.9 | Δ | ○ | Δ | ○ | 30 |
| Comparative Example 36 | B6 | 90 | B3 | 10 | 88.0 | x | ○ | x | ○ | 30 |
| Comparative Example 37 | B6 | 90 | B4 | 10 | 87.9 | Δ | ○ | Δ | ○ | 30 |
| Comparative Example 38 | B6 | 90 | B5 | 10 | 88.1 | Δ | ○ | Δ | ○ | 30 |
| Example 17 | B6 | 90 | B7 | 10 | 86.6 | ○ | ○ | ○ | ○ | 30 |
| Example 18 | B6 | 90 | B8 | 10 | 86.5 | ○ | ○ | ○ | ○ | 30 |
| Comparative Example 39 | B6 | 90 | B9 | 10 | 87.1 | Δ | ○ | Δ | ○ | 30 |
| Comparative Example 40 | B7 | 90 | B1 | 10 | 78.0 | ○ | x | ○ | x | 30 |
| Comparative Example 41 | B7 | 90 | B2 | 10 | 78.4 | ○ | x | ○ | x | 30 |
| Comparative Example 42 | B7 | 90 | B3 | 10 | 78.5 | ○ | x | ○ | x | 30 |
| Comparative Example 43 | B7 | 90 | B4 | 10 | 78.3 | ○ | x | ○ | x | 30 |
| Comparative Example 44 | B7 | 90 | B5 | 10 | 78.5 | ○ | x | ○ | x | 30 |
| Comparative Example 45 | B7 | 90 | B6 | 10 | 78.4 | ○ | x | ○ | x | 30 |
| Comparative Example 46 | B7 | 90 | B8 | 10 | 76.9 | ○ | x | ○ | x | 30 |
| Comparative Example 47 | B7 | 90 | B9 | 10 | 77.6 | ○ | x | ○ | x | 30 |
| Comparative Example 48 | B8 | 90 | B1 | 10 | 74.6 | ○ | x | ○ | x | 30 |
| Comparative Example 49 | B8 | 90 | B2 | 10 | 75.0 | ○ | x | ○ | x | 30 |
| Comparative Example 50 | B8 | 90 | B3 | 10 | 75.0 | ○ | x | ○ | x | 30 |
| Comparative Example 51 | B8 | 90 | B4 | 10 | 74.9 | ○ | x | ○ | x | 30 |
| Comparative Example 52 | B8 | 90 | B5 | 10 | 75.1 | ○ | x | ○ | x | 30 |
| Comparative Example 53 | B8 | 90 | B6 | 10 | 74.9 | ○ | x | ○ | x | 30 |
| Comparative Example 54 | B8 | 90 | B7 | 10 | 73.9 | ○ | x | ○ | x | 30 |
| Comparative Example 55 | B8 | 90 | B9 | 10 | 74.2 | ○ | x | ○ | x | 30 |

TABLE 7

| | First binder resin | | Second binder resin | | Contact | Monochrome printer | | Color printer | | Single layer |
|---|---|---|---|---|---|---|---|---|---|---|
| | Material | Content (% by mass) | Material | Content (% by mass) | angle (°) | Black spot | Filming | Color spot | Filming | thickness (μm) |
| Comparative Example 56 | B9 | 90 | B1 | 10 | 80.7 | ○ | Δ | ○ | Δ | 30 |
| Comparative Example 57 | B9 | 90 | B2 | 10 | 81.1 | ○ | Δ | ○ | Δ | 30 |
| Comparative Example 58 | B9 | 90 | B3 | 10 | 81.2 | ○ | Δ | ○ | Δ | 30 |
| Comparative Example 59 | B9 | 90 | B4 | 10 | 81.0 | ○ | Δ | ○ | Δ | 30 |
| Comparative Example 60 | B9 | 90 | B5 | 10 | 81.2 | ○ | Δ | ○ | Δ | 30 |
| Comparative Example 61 | B9 | 90 | B6 | 10 | 81.1 | ○ | Δ | ○ | Δ | 30 |
| Comparative Example 62 | B9 | 90 | B7 | 10 | 80.0 | ○ | Δ | ○ | Δ | 30 |
| Comparative Example 63 | B9 | 90 | B8 | 10 | 79.6 | ○ | Δ | ○ | Δ | 30 |

TABLE 7-continued

| | First binder resin | | Second binder resin | | Contact | Monochrome printer | | Color printer | | Single layer |
|---|---|---|---|---|---|---|---|---|---|---|
| | Material | Content (% by mass) | Material | Content (% by mass) | angle (°) | Black spot | Filming | Color spot | Filming | thickness (μm) |
| Example 19 | B1 | 90 | B2 | 10 | 84.7 | ○ | ○ | ○ | ○ | 25 |
| Example 20 | B1 | 90 | B2 | 10 | 84.5 | ○ | ○ | ○ | ○ | 20 |
| Example 21 | B1 | 100 | — | — | 84.7 | ○ | ○ | ○ | ○ | 30 |
| Example 22 | B1 | 100 | — | — | 84.7 | ○ | ○ | ○ | ○ | 30 |
| Example 47 | B1 | 90 | B2 | 10 | 85.0 | ○ | ○ | ○ | ○ | 25 |
| Example 48 | B1 | 90 | B2 | 10 | 85.0 | ○ | ○ | ○ | ○ | 20 |

TABLE 8

| | First binder resin | | Second binder resin | | Contact | Monochrome printer | | Color printer | | Laminate |
|---|---|---|---|---|---|---|---|---|---|---|
| | Material | Content (% by mass) | Material | Content (% by mass) | angle (°) | Black spot | Filming | Color spot | Filming | thickness (μm) |
| Example 23 | B1 | 100 | — | — | 84.7 | ○ | ○ | ○ | ○ | 30 |
| Comparative Example 64 | B2 | 100 | — | — | 88.0 | x | ○ | x | ○ | 30 |
| Comparative Example 65 | B3 | 100 | — | — | 88.9 | Δ | ○ | Δ | ○ | 30 |
| Comparative Example 66 | B4 | 100 | — | — | 87.5 | Δ | ○ | Δ | ○ | 30 |
| Comparative Example 67 | B5 | 100 | — | — | 89.5 | x | ○ | x | ○ | 30 |
| Comparative Example 68 | B6 | 100 | — | — | 87.9 | Δ | ○ | Δ | ○ | 30 |
| Comparative Example 69 | B7 | 100 | — | — | 77.3 | ○ | x | ○ | x | 30 |
| Comparative Example 70 | B8 | 100 | — | — | 73.5 | ○ | x | ○ | x | 30 |
| Comparative Example 71 | B9 | 100 | — | — | 80.3 | ○ | x | ○ | x | 30 |
| Example 24 | B1 | 90 | B2 | 10 | 85.0 | ○ | ○ | ○ | ○ | 30 |
| Example 25 | B1 | 90 | B3 | 10 | 85.1 | ○ | ○ | ○ | ○ | 30 |
| Example 26 | B1 | 90 | B4 | 10 | 85.0 | ○ | ○ | ○ | ○ | 30 |
| Example 27 | B1 | 90 | B5 | 10 | 85.2 | ○ | ○ | ○ | ○ | 30 |
| Example 28 | B1 | 90 | B6 | 10 | 85.0 | ○ | ○ | ○ | ○ | 30 |
| Example 29 | B1 | 90 | B7 | 10 | 84.0 | ○ | ○ | ○ | ○ | 30 |
| Example 30 | B1 | 90 | B8 | 10 | 83.6 | ○ | ○ | ○ | ○ | 30 |
| Example 31 | B1 | 90 | B9 | 10 | 84.3 | ○ | ○ | ○ | ○ | 30 |
| Comparative Example 72 | B2 | 90 | B1 | 10 | 87.7 | Δ | ○ | Δ | ○ | 30 |
| Comparative Example 73 | B2 | 90 | B3 | 10 | 88.1 | Δ | ○ | Δ | ○ | 30 |
| Comparative Example 74 | B2 | 90 | B4 | 10 | 88.0 | Δ | ○ | Δ | ○ | 30 |
| Comparative Example 75 | B2 | 90 | B5 | 10 | 88.2 | Δ | ○ | Δ | ○ | 30 |
| Comparative Example 76 | B2 | 90 | B6 | 10 | 88.0 | Δ | ○ | Δ | ○ | 30 |
| Example 32 | B2 | 90 | B7 | 10 | 86.9 | ○ | ○ | ○ | ○ | 30 |
| Example 33 | B2 | 90 | B8 | 10 | 86.6 | ○ | ○ | ○ | ○ | 30 |
| Comparative Example 77 | B2 | 90 | B9 | 10 | 87.2 | Δ | ○ | Δ | ○ | 30 |

TABLE 9

| | First binder resin | | Second binder resin | | Contact | Monochrome printer | | Color printer | | Laminate |
|---|---|---|---|---|---|---|---|---|---|---|
| | Material | Content (% by mass) | Material | Content (% by mass) | angle (°) | Black spot | Filming | Color spot | Filming | thickness (μm) |
| Comparative Example 78 | B3 | 90 | B1 | 10 | 88.5 | x | ○ | x | ○ | 30 |
| Comparative Example 79 | B3 | 90 | B2 | 10 | 88.8 | x | ○ | x | ○ | 30 |
| Comparative Example 80 | B3 | 90 | B4 | 10 | 88.8 | x | ○ | x | ○ | 30 |

TABLE 9-continued

| | First binder resin | | Second binder resin | | Contact | Monochrome printer | | Color printer | | Laminate |
|---|---|---|---|---|---|---|---|---|---|---|
| | Material | Content (% by mass) | Material | Content (% by mass) | angle (°) | Black spot | Filming | Color spot | Filming | thickness (μm) |
| Comparative Example 81 | B3 | 90 | B5 | 10 | 89.0 | x | ○ | x | ○ | 30 |
| Comparative Example 82 | B3 | 90 | B6 | 10 | 88.8 | x | ○ | x | ○ | 30 |
| Comparative Example 83 | B3 | 90 | B7 | 10 | 87.7 | Δ | ○ | Δ | ○ | 30 |
| Comparative Example 84 | B3 | 90 | B8 | 10 | 87.4 | Δ | ○ | Δ | ○ | 30 |
| Example 34 | B3 | 90 | B9 | 10 | 86.5 | ○ | ○ | ○ | ○ | 30 |
| Example 35 | B4 | 90 | B1 | 10 | 86.5 | ○ | ○ | ○ | ○ | 30 |
| Comparative Example 85 | B4 | 90 | B2 | 10 | 87.6 | Δ | ○ | Δ | ○ | 30 |
| Comparative Example 86 | B4 | 90 | B3 | 10 | 87.6 | Δ | ○ | Δ | ○ | 30 |
| Comparative Example 87 | B4 | 90 | B5 | 10 | 87.7 | Δ | ○ | Δ | ○ | 30 |
| Comparative Example 88 | B4 | 90 | B6 | 10 | 87.5 | Δ | ○ | Δ | ○ | 30 |
| Example 36 | B4 | 90 | B7 | 10 | 86.5 | ○ | ○ | ○ | ○ | 30 |
| Example 37 | B4 | 90 | B8 | 10 | 86.1 | ○ | ○ | ○ | ○ | 30 |
| Example 38 | B4 | 90 | B9 | 10 | 86.6 | ○ | ○ | ○ | ○ | 30 |
| Comparative Example 89 | B5 | 90 | B1 | 10 | 89.0 | Δ | ○ | Δ | ○ | 30 |
| Comparative Example 90 | B5 | 90 | B2 | 10 | 89.4 | x | ○ | x | ○ | 30 |
| Comparative Example 91 | B5 | 90 | B3 | 10 | 89.4 | x | ○ | x | ○ | 30 |
| Comparative Example 92 | B5 | 90 | B4 | 10 | 89.3 | x | ○ | x | ○ | 30 |
| Comparative Example 93 | B5 | 90 | B6 | 10 | 89.3 | x | ○ | x | ○ | 30 |
| Comparative Example 94 | B5 | 90 | B7 | 10 | 88.3 | Δ | ○ | Δ | ○ | 30 |
| Comparative Example 95 | B5 | 90 | B8 | 10 | 87.9 | Δ | ○ | Δ | ○ | 30 |
| Comparative Example 96 | B5 | 90 | B9 | 10 | 88.6 | Δ | ○ | Δ | ○ | 30 |

TABLE 10

| | First binder resin | | Second binder resin | | Contact | Monochrome printer | | Color printer | | Laminate |
|---|---|---|---|---|---|---|---|---|---|---|
| | Material | Content (% by mass) | Material | Content (% by mass) | angle (°) | Black spot | Filming | Color spot | Filming | thickness (μm) |
| Comparative Example 97 | B6 | 90 | B1 | 10 | 87.6 | Δ | ○ | Δ | ○ | 30 |
| Comparative Example 98 | B6 | 90 | B2 | 10 | 87.9 | Δ | ○ | Δ | ○ | 30 |
| Comparative Example 99 | B6 | 90 | B3 | 10 | 88.0 | x | ○ | x | ○ | 30 |
| Comparative Example 100 | B6 | 90 | B4 | 10 | 87.9 | Δ | ○ | Δ | ○ | 30 |
| Comparative Example 101 | B6 | 90 | B5 | 10 | 88.1 | Δ | ○ | Δ | ○ | 30 |
| Example 39 | B6 | 90 | B7 | 10 | 86.6 | ○ | ○ | ○ | ○ | 30 |
| Example 40 | B6 | 90 | B8 | 10 | 86.5 | ○ | ○ | ○ | ○ | 30 |
| Comparative Example 102 | B6 | 90 | B9 | 10 | 87.1 | Δ | ○ | Δ | ○ | 30 |
| Comparative Example 103 | B7 | 90 | B1 | 10 | 78.0 | ○ | x | ○ | x | 30 |
| Comparative Example 104 | B7 | 90 | B2 | 10 | 78.4 | ○ | x | ○ | x | 30 |
| Comparative Example 105 | B7 | 90 | B3 | 10 | 78.5 | ○ | x | ○ | x | 30 |
| Comparative Example 106 | B7 | 90 | B4 | 10 | 78.3 | ○ | x | ○ | x | 30 |
| Comparative Example 107 | B7 | 90 | B5 | 10 | 78.5 | ○ | x | ○ | x | 30 |

TABLE 10-continued

| | First binder resin | | Second binder resin | | Contact | Monochrome printer | | Color printer | | Laminate |
|---|---|---|---|---|---|---|---|---|---|---|
| | Material | Content (% by mass) | Material | Content (% by mass) | angle (°) | Black spot | Filming | Color spot | Filming | thickness (μm) |
| Comparative Example 108 | B7 | 90 | B6 | 10 | 78.4 | ○ | x | ○ | x | 30 |
| Comparative Example 109 | B7 | 90 | B8 | 10 | 76.9 | ○ | x | ○ | x | 30 |
| Comparative Example 110 | B7 | 90 | B9 | 10 | 77.6 | ○ | x | ○ | x | 30 |
| Comparative Example 111 | B8 | 90 | B1 | 10 | 74.6 | ○ | x | ○ | x | 30 |
| Comparative Example 112 | B8 | 90 | B2 | 10 | 75.0 | ○ | x | ○ | x | 30 |
| Comparative Example 113 | B8 | 90 | B3 | 10 | 75.0 | ○ | x | ○ | x | 30 |
| Comparative Example 114 | B8 | 90 | B4 | 10 | 74.9 | ○ | x | ○ | x | 30 |
| Comparative Example 115 | B8 | 90 | B5 | 10 | 75.1 | ○ | x | ○ | x | 30 |
| Comparative Example 116 | B8 | 90 | B6 | 10 | 74.9 | ○ | x | ○ | x | 30 |
| Comparative Example 117 | B8 | 90 | B7 | 10 | 73.9 | ○ | x | ○ | x | 30 |
| Comparative Example 118 | B8 | 90 | B9 | 10 | 74.2 | ○ | x | ○ | x | 30 |

TABLE 11

| | First binder resin | | Second binder resin | | Contact | Monochrome printer | | Color printer | | Laminate |
|---|---|---|---|---|---|---|---|---|---|---|
| | Material | Content (% by mass) | Material | Content (% by mass) | angle (°) | Black spot | Filming | Color spot | Filming | thickness (μm) |
| Comparative Example 119 | B9 | 90 | B1 | 10 | 80.7 | ○ | Δ | ○ | Δ | 30 |
| Comparative Example 120 | B9 | 90 | B2 | 10 | 81.1 | ○ | Δ | ○ | Δ | 30 |
| Comparative Example 121 | B9 | 90 | B3 | 10 | 81.2 | ○ | Δ | ○ | Δ | 30 |
| Comparative Example 122 | B9 | 90 | B4 | 10 | 81.0 | ○ | Δ | ○ | Δ | 30 |
| Comparative Example 123 | B9 | 90 | B5 | 10 | 81.2 | ○ | Δ | ○ | Δ | 30 |
| Comparative Example 124 | B9 | 90 | B6 | 10 | 81.1 | ○ | Δ | ○ | Δ | 30 |
| Comparative Example 125 | B9 | 90 | B7 | 10 | 80.0 | ○ | Δ | ○ | Δ | 30 |
| Comparative Example 126 | B9 | 90 | B8 | 10 | 79.6 | ○ | Δ | ○ | Δ | 30 |
| Example 41 | B1 | 90 | B2 | 10 | 85.4 | ○ | ○ | ○ | ○ | 38 |
| Example 42 | B1 | 90 | B2 | 10 | 84.3 | ○ | ○ | ○ | ○ | 17 |
| Example 43 | B1 | 100 | — | — | 84.7 | ○ | ○ | ○ | ○ | 30 |
| Example 44 | B1 | 100 | — | — | 84.7 | ○ | ○ | ○ | ○ | 30 |
| Example 45 | B1 | 100 | — | — | 84.7 | ○ | ○ | ○ | ○ | 30 |
| Example 46 | B1 | 100 | — | — | 84.7 | ○ | ○ | ○ | ○ | 30 |
| Example 49 | B1 | 90 | B2 | 10 | 85.0 | ○ | ○ | ○ | ○ | 38 |
| Example 50 | B1 | 90 | B2 | 10 | 85.0 | ○ | ○ | ○ | ○ | 17 |

As shown in Tables above, both single layer-type photoreceptors and laminate-type photoreceptors yielded similar results regardless of whether they were used in the monochrome printer or the color printer. That is, it was confirmed that a good evaluation of "○" was obtained in all of Examples, while an evaluation of "x" or "Δ" was obtained for the generation level of fine black spots or color spots, or the occurrence level of filming.

From the above results, it was confirmed that, according to the present invention, an electrophotographic photoreceptor which, even when mounted on a high-image-quality monochrome high-speed printer or tandem color printer comprising a cleaner-less process of a non-magnetic single-component contact development system using a polymerized toner, inhibits the generation of fine black spots or color spots and suppresses the occurrence of toner filming during the initial printing under a high-temperature and high-humidity environment and thereby stably attains a high image quality in a variety of environments; a method for producing the same; and an electrophotographic apparatus using the same can be realized.

What is claimed is:

1. A positively-chargeable electrophotographic photoreceptor, comprising:

a conductive support; and a single layer-type photosensitive layer containing a charge generation material, a hole transport material, an electron transport material and a binder resin arranged on the conductive support, wherein the charge generation material contains at least a titanyl phthalocyanine, and a contact angle between the surface of the single layer-type photosensitive layer and water ranges from 81° to 87°, wherein the binder resin of the single layer-type photosensitive layer contains a resin having repeating units represented by Formula (1) below and a resin having repeating units represented by Formula (2) below:

(1)

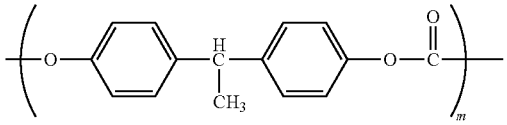

2. The electrophotographic photoreceptor according to claim 1, wherein the contact angle ranges from 82° to 87°.

3. A method for producing the electrophotographic photoreceptor according to claim 1, comprising:

forming the single layer-type photosensitive layer by a dip coating method.

4. An electrophotographic apparatus equipped with the electrophotographic photoreceptor according to claim 1.

5. The electrophotographic apparatus according to claim 4, further comprising a non-magnetic, single-component, contact development system using a polymerized toner to provide a cleaner-less process.

6. A positively-chargeable electrophotographic photoreceptor, comprising:

a conductive support;

a charge transport layer that contains at least a hole transport material and a binder resin and that is arranged on the conductive support; and a charge generation layer containing at least a charge generation material, a hole transport material, an electron transport material and a binder resin arranged on the charge transport layer, wherein a contact angle between the surface of the charge generation layer and water ranges from 81° to 87°, and wherein the binder resin of the charge generation layer contains a resin having repeating units represented by Formula (1) below and a resin having repeating units represented by Formula (2) below:

(1)

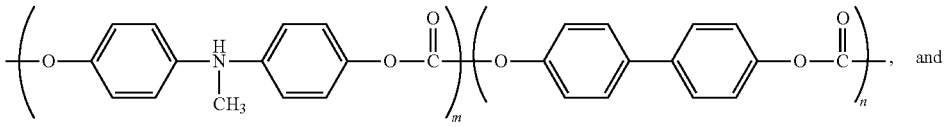

m/(m + n) = 0.6~0.9

(2)

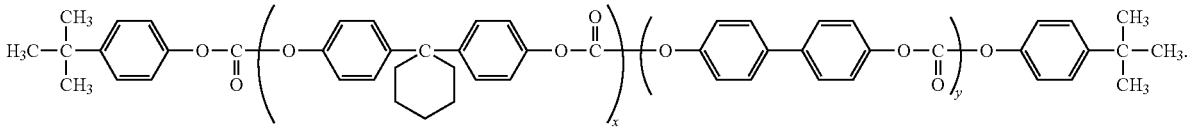

x/(x + y) = 0.6~0.9

-continued

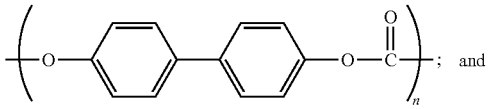

m/(m + n) = 0.6~0.9

(2)

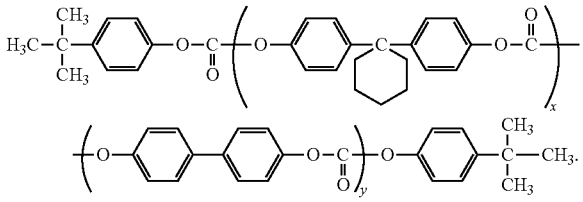

x/(x + y) = 0.6~0.9

7. The electrophotographic photoreceptor according to claim 6, wherein the charge generation material contains at least a titanyl phthalocyanine.

8. The electrophotographic photoreceptor according to claim 6, wherein the contact angle ranges from 82° to 87°.

9. A method for producing the electrophotographic photoreceptor according to claim 6, comprising:

forming the charge generation layer by a dip coating method.

10. An electrophotographic apparatus equipped with the electrophotographic photoreceptor according to claim 6.

11. The electrophotographic apparatus according to claim 10, further comprising a non-magnetic, single-component, contact development system using a polymerized toner to provide a cleaner-less process.

12. A positively-chargeable electrophotographic photoreceptor, comprising:

a conductive support; and a single layer-type photosensitive layer containing a charge generation material, a hole transport material, an electron transport material and a binder resin arranged on the conductive support, wherein the charge generation material contains at least a titanyl phthalocyanine, and a contact angle between the surface of the single layer-type photosensitive layer and water ranges from 81° to 87°, and wherein the binder resin of the single layer-type photosensitive layer contains a resin having repeating units represented by Formula (2) below and a resin having repeating units represented by Formula (3) below:

(2)

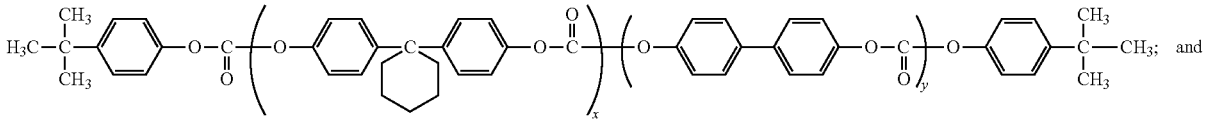

x/(x + y) = 0.6~0.9

(3)

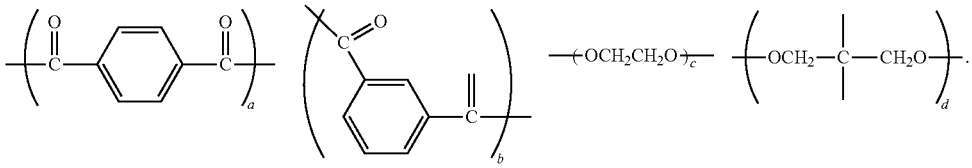

a + b + c + d = 100 mol %, |a + b| - |c + d| ≤ 1 mol %

13. The electrophotographic photoreceptor according to claim 12, wherein the contact angle ranges from 82° to 87°.

14. A method for producing the electrophotographic photoreceptor according to claim 12, comprising:

forming the single layer-type photosensitive layer by a dip coating method.

15. An electrophotographic apparatus equipped with the electrophotographic photoreceptor according to claim 12.

16. The electrophotographic apparatus according to claim 15, further comprising a non-magnetic, single-component, contact development system using a polymerized toner to provide a cleaner-less process.

17. A positively-chargeable electrophotographic photoreceptor, comprising:

a conductive support;

a charge transport layer that contains at least a hole transport material and a binder resin and that is arranged on the conductive support; and a charge generation layer containing at least a charge generation material, a hole transport material, an electron transport material and a binder resin arranged on the charge transport layer, wherein a contact angle between the surface of the charge generation layer and water ranges from 81° to 87°, and wherein the binder resin of the charge generation layer contains a resin having repeating units represented by Formula (2) below and a resin having repeating units represented by Formula (3) below:

(2)

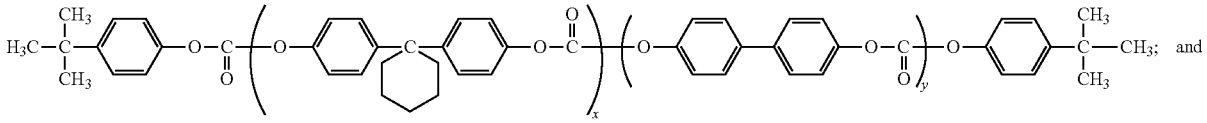

x/(x + y) = 0.6~0.9

(3)

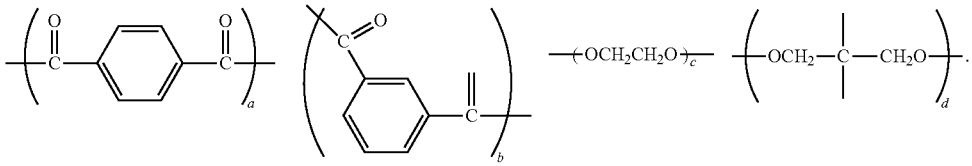

a + b + c + d = 100 mol %, |a + b| - |c + d| ≤ 1 mol %

18. The electrophotographic photoreceptor according to claim 17, wherein the charge generation material contains at least a titanyl phthalocyanine.

19. The electrophotographic photoreceptor according to claim 17, wherein the contact angle ranges from 82° to 87°.

20. A method for producing the electrophotographic photoreceptor according to claim 17, comprising:

forming the charge generation layer by a dip coating method.

21. An electrophotographic apparatus equipped with the electrophotographic photoreceptor according to claim 17.

22. The electrophotographic apparatus according to claim 21, further comprising a non-magnetic, single-component, contact development system using a polymerized toner to provide a cleaner-less process.

* * * * *